US007862445B2

(12) United States Patent
Huang

(10) Patent No.: US 7,862,445 B2
(45) **Date of Patent: *Jan. 4, 2011**

(54) GRIP HAVING A STABILIZED GRIPPING SURFACE

(76) Inventor: Ben Huang, 19742 Woodlands La., Huntington Beach, CA (US) 92648

( * ) Notice: Subject to any disclaimer, the term of this patent is extended or adjusted under 35 U.S.C. 154(b) by 454 days.

This patent is subject to a terminal disclaimer.

(21) Appl. No.: 11/689,452

(22) Filed: Mar. 21, 2007

(65) Prior Publication Data

US 2008/0230174 A1 Sep. 25, 2008

(51) Int. Cl.
*A63B 53/14* (2006.01)

(52) U.S. Cl. ..... 473/300; 156/314

(58) Field of Classification Search ..... 473/300–303; 156/314

See application file for complete search history.

(56) References Cited

U.S. PATENT DOCUMENTS

| | | | |
|---|---|---|---|
| 571,025 | A | 11/1896 | Spamer |
| 834,711 | A | 10/1906 | Clarke et al. |
| 979,266 | A | 12/1910 | Dean |
| 1,008,604 | A | 11/1911 | Lake |
| 1,017,565 | A | 2/1912 | Lard |
| 1,139,843 | A | 5/1915 | Brown |
| 1,345,505 | A | 7/1920 | Persons |
| 1,435,088 | A | 11/1922 | Smith |
| 1,522,635 | A | 1/1925 | Kraeuter |
| 1,528,190 | A | 3/1925 | Howe |
| 1,617,972 | A | 2/1927 | Wallace |
| 1,890,037 | A | 12/1932 | Johnson |
| 1,943,399 | A | 1/1934 | Smith |
| 2,000,295 | A | 5/1935 | Oldham |
| 2,086,062 | A | 7/1937 | Bray |
| 2,103,889 | A | 12/1937 | Brisick |
| 2,149,911 | A | 3/1939 | East |
| 2,206,056 | A | 7/1940 | Sheesley |
| 2,221,421 | A | 11/1940 | Curry |
| 2,225,839 | A | 12/1940 | Moore |
| 2,449,575 | A | 9/1948 | Wilhelm |
| 2,523,637 | A | 9/1950 | Stanfield et al. |

(Continued)

FOREIGN PATENT DOCUMENTS

| | | | |
|---|---|---|---|
| CN | 2139008 | Y | 7/1993 |

(Continued)

OTHER PUBLICATIONS

European Search Report, European Application No. EP 04 25 7967, 4 pages- cites: US 2004/185958; EP 1 371 397; US 2,225,839; US 6,666,777; US 5,839,983; US 5,577,722; and US 979,266.

(Continued)

*Primary Examiner*—Stephen L. Blau
(74) *Attorney, Agent, or Firm*—Knobbe Martens Olson & Bear LLP

(57) ABSTRACT

The disclosure herein includes a grip for a golf club with a flexible tube and a layered sheet. The tube includes a tubular body and raised portions extending from the tubular body. The outer surface of the raised portions cooperates with the layered sheet to form a gripping surface. The grip reduces impact shock and provides a feeling of tackiness while providing increased variation in the physical characteristics of the gripping surface.

34 Claims, 21 Drawing Sheets

U.S. PATENT DOCUMENTS

| | | | | |
|---|---|---|---|---|
| 2,671,660 | A | | 3/1954 | Goodwin |
| 2,690,338 | A | | 9/1954 | Brocke |
| 2,772,090 | A | | 11/1956 | Brandon |
| 2,934,285 | A | | 4/1960 | Niehaus |
| 2,984,486 | A | | 5/1961 | Jones |
| 3,028,283 | A | | 4/1962 | Lundgren et al. |
| 3,059,816 | A | | 10/1962 | Goldstein |
| 3,073,055 | A | | 1/1963 | Edwards et al. |
| 3,087,729 | A | | 4/1963 | Sullivan |
| 3,095,198 | A | | 6/1963 | Gasche |
| 3,140,873 | A | | 7/1964 | Goodwin |
| 3,157,723 | A | | 11/1964 | Hochberg |
| 3,311,375 | A | | 3/1967 | Onions |
| 3,366,384 | A | | 1/1968 | Lamkin et al. |
| 3,368,811 | A | | 2/1968 | Finney |
| 3,503,784 | A | * | 3/1970 | Eiichi et al. ..... 442/63 |
| 3,606,325 | A | | 9/1971 | Lamkin et al. |
| 3,857,745 | A | | 12/1974 | Grausch et al. |
| 3,876,320 | A | | 4/1975 | Phillipson |
| 3,922,402 | A | | 11/1975 | Shimamura et al. |
| 3,973,348 | A | | 8/1976 | Shell |
| 3,992,021 | A | | 11/1976 | Tobin |
| 4,012,039 | A | | 3/1977 | Yerke |
| 4,015,851 | A | | 4/1977 | Pennell |
| 4,052,061 | A | | 10/1977 | Stewart |
| 4,133,529 | A | | 1/1979 | Gambino |
| 4,137,360 | A | | 1/1979 | Reischl |
| 4,216,251 | A | | 8/1980 | Nishimura et al. |
| 4,284,275 | A | | 8/1981 | Fletcher |
| 4,347,280 | A | | 8/1982 | Lau et al. |
| 4,358,499 | A | | 11/1982 | Hill |
| 4,448,922 | A | | 5/1984 | McCartney |
| 4,535,649 | A | | 8/1985 | Stahel |
| 4,613,537 | A | | 9/1986 | Krüpper |
| 4,651,991 | A | | 3/1987 | McDuff |
| 4,662,415 | A | | 5/1987 | Proutt |
| 4,765,856 | A | | 8/1988 | Doubt |
| 4,878,667 | A | | 11/1989 | Tosti |
| 4,919,420 | A | | 4/1990 | Sato |
| 4,941,232 | A | | 7/1990 | Decker et al. |
| 4,971,837 | A | | 11/1990 | Martz et al. |
| 5,024,866 | A | | 6/1991 | Goode |
| 5,055,340 | A | | 10/1991 | Matsumura et al. |
| 5,118,107 | A | | 6/1992 | Bucher |
| 5,123,646 | A | | 6/1992 | Overby et al. |
| 5,127,650 | A | | 7/1992 | Schneller |
| 5,261,665 | A | | 11/1993 | Downey |
| 5,322,290 | A | * | 6/1994 | Minami ..... 473/201 |
| 5,343,776 | A | | 9/1994 | Falco |
| 5,374,059 | A | | 12/1994 | Huang |
| 5,396,727 | A | | 3/1995 | Furuya et al. |
| 5,427,376 | A | | 6/1995 | Cummings et al. |
| 5,469,601 | A | | 11/1995 | Jackson |
| 5,474,802 | A | | 12/1995 | Shimoda et al. |
| 5,480,146 | A | | 1/1996 | Comer |
| 5,485,996 | A | | 1/1996 | Niksich |
| 5,511,445 | A | | 4/1996 | Hildebrandt |
| 5,537,773 | A | | 7/1996 | Matsubara et al. |
| 5,570,884 | A | | 11/1996 | Carps |
| 5,571,050 | A | | 11/1996 | Huang |
| 5,577,722 | A | | 11/1996 | Glassberg |
| 5,584,482 | A | | 12/1996 | Huang |
| 5,595,544 | A | | 1/1997 | Roelke |
| 5,611,533 | A | | 3/1997 | Williams |
| 5,624,116 | A | | 4/1997 | Yeh |
| 5,626,527 | A | | 5/1997 | Eberlein |
| 5,634,859 | A | | 6/1997 | Nesbitt |
| 5,645,501 | A | | 7/1997 | Huang |
| 5,671,923 | A | | 9/1997 | Huang |
| 5,690,566 | A | | 11/1997 | Bracho |
| 5,695,418 | A | | 12/1997 | Huang |
| 5,730,662 | A | | 3/1998 | Rens |
| 5,730,669 | A | | 3/1998 | Huang |
| 5,772,524 | A | | 6/1998 | Huang |
| 5,781,963 | A | | 7/1998 | Maru et al. |
| 5,797,813 | A | | 8/1998 | Huang |
| 5,803,828 | A | | 9/1998 | Huang |
| 5,813,921 | A | | 9/1998 | Huang |
| 5,816,933 | A | | 10/1998 | Huang |
| 5,816,934 | A | | 10/1998 | Huang |
| 5,827,129 | A | | 10/1998 | Huang |
| 5,839,983 | A | | 11/1998 | Kramer |
| 5,851,632 | A | | 12/1998 | Chen et al. |
| 5,857,929 | A | | 1/1999 | Huang |
| 5,867,868 | A | | 2/1999 | Ward |
| 5,890,260 | A | | 4/1999 | Gaunt |
| 5,890,972 | A | | 4/1999 | Huang |
| 5,895,329 | A | | 4/1999 | Huang |
| 5,910,054 | A | | 6/1999 | Huang |
| 5,924,941 | A | | 7/1999 | Hagey |
| 5,997,421 | A | | 12/1999 | Huang |
| 6,036,607 | A | | 3/2000 | Finegan |
| 6,048,275 | A | * | 4/2000 | Gedeon ..... 473/293 |
| 6,197,392 | B1 | | 3/2001 | Jones |
| 6,226,836 | B1 | | 5/2001 | Yasui |
| 6,244,975 | B1 | | 6/2001 | Huang |
| 6,261,191 | B1 | | 7/2001 | Chen |
| 6,360,475 | B1 | | 3/2002 | Lepage et al. |
| 6,361,450 | B1 | | 3/2002 | Huang |
| 6,386,989 | B1 | | 5/2002 | Huang |
| D463,520 | S | | 9/2002 | Ulrich |
| 6,449,803 | B1 | | 9/2002 | McConchie |
| 6,503,153 | B2 | | 1/2003 | Wang |
| 6,506,128 | B1 | | 1/2003 | Bloom, Jr. |
| 6,511,732 | B1 | | 1/2003 | Chao |
| 6,551,198 | B2 | | 4/2003 | Huang |
| 6,558,270 | B2 | | 5/2003 | Kwitek |
| 6,627,027 | B2 | | 9/2003 | Huang |
| 6,629,901 | B2 | | 10/2003 | Huang |
| 6,635,688 | B2 | | 10/2003 | Simpson |
| 6,652,398 | B2 | | 11/2003 | Falone et al. |
| 6,656,054 | B2 | | 12/2003 | Ulrich |
| 6,656,057 | B2 | | 12/2003 | Manual et al. |
| 6,663,500 | B2 | | 12/2003 | Huang |
| 6,666,777 | B1 | | 12/2003 | Lamkin et al. |
| 6,676,534 | B2 | | 1/2004 | Huang |
| 6,695,713 | B2 | | 2/2004 | Huang |
| 6,709,346 | B1 | | 3/2004 | Wang |
| 6,733,401 | B1 | | 5/2004 | Huang |
| 6,827,656 | B1 | | 12/2004 | Hoeflich et al. |
| 6,843,732 | B1 | | 1/2005 | Huang |
| 6,857,971 | B2 | * | 2/2005 | Huang ..... 473/300 |
| 6,908,400 | B2 | | 6/2005 | Chu et al. |
| 6,973,750 | B1 | | 12/2005 | Kim |
| 7,008,582 | B2 | | 3/2006 | Chen |
| 7,048,644 | B2 | | 5/2006 | Wang |
| 7,137,904 | B2 | | 11/2006 | Huang |
| 7,140,973 | B2 | | 11/2006 | Rohrer |
| D534,602 | S | | 1/2007 | Norton et al. |
| D534,603 | S | | 1/2007 | Norton et al. |
| D534,604 | S | | 1/2007 | Norton et al. |
| D534,605 | S | | 1/2007 | Norton et al. |
| D534,607 | S | | 1/2007 | Norton et al. |
| D534,975 | S | | 1/2007 | Norton et al. |
| D536,048 | S | | 1/2007 | Chen |
| D538,868 | S | | 3/2007 | Norton et al. |
| D538,869 | S | | 3/2007 | Wang et al. |
| 7,186,189 | B2 | | 3/2007 | Huang |
| 7,195,568 | B2 | | 3/2007 | Huang |
| 7,219,395 | B2 | | 5/2007 | Bigolin |
| 7,344,447 | B2 | | 3/2008 | Chang |
| 7,344,448 | B2 | | 3/2008 | Huang |
| 7,374,498 | B2 | | 5/2008 | Huang |
| 7,404,770 | B2 | | 7/2008 | Huang |

| | | | | |
|---|---|---|---|---|
| 7,438,646 | B2 | 10/2008 | Huang | |
| 7,448,957 | B2 | 11/2008 | Huang | |
| 7,448,958 | B2 | 11/2008 | Huang | |
| 7,458,903 | B2 * | 12/2008 | Wang et al. | 473/300 |
| 7,470,199 | B2 | 12/2008 | Huang | |
| 7,527,564 | B2 | 5/2009 | Huang | |
| 7,566,375 | B2 | 7/2009 | Huang | |
| 7,585,230 | B2 | 9/2009 | Huang | |
| 2002/0028264 | A1 | 3/2002 | Hoopman et al. | |
| 2002/0028325 | A1 | 3/2002 | Simpson | |
| 2002/0142858 | A1 | 10/2002 | Chen | |
| 2002/0142900 | A1 | 10/2002 | Wang | |
| 2002/0173371 | A1 | 11/2002 | Lamkin et al. | |
| 2003/0040384 | A1 | 2/2003 | Falone et al. | |
| 2003/0045370 | A1 | 3/2003 | Jaw | |
| 2003/0062654 | A1 | 4/2003 | Lamkin | |
| 2003/0139223 | A1 | 7/2003 | Ulrich et al. | |
| 2003/0148836 | A1 | 8/2003 | Falone et al. | |
| 2003/0150081 | A1 | 8/2003 | Wang | |
| 2003/0216192 | A1 | 11/2003 | Chu | |
| 2003/0228930 | A1 | 12/2003 | Huang | |
| 2004/0029645 | A1 | 2/2004 | Chen | |
| 2004/0029646 | A1 | 2/2004 | Chu et al. | |
| 2004/0031128 | A1 | 2/2004 | Chen | |
| 2004/0109980 | A1 | 6/2004 | Chen et al. | |
| 2004/0123429 | A1 | 7/2004 | Wang | |
| 2004/0185958 | A1 | 9/2004 | Huang | |
| 2005/0276925 | A1 | 12/2005 | Su | |
| 2005/0287329 | A1 | 12/2005 | Lai | |
| 2006/0172815 | A1 | 8/2006 | Chu | |
| 2006/0252571 | A1 | 11/2006 | Wang | |
| 2006/0287123 | A1 | 12/2006 | Wang | |
| 2007/0032309 | A1 * | 2/2007 | Chang | 473/300 |
| 2007/0149307 | A1 | 6/2007 | Huang | |
| 2008/0229646 | A1 | 9/2008 | Huang | |
| 2008/0283178 | A1 | 11/2008 | Huang | |
| 2009/0258722 | A1 | 10/2009 | Huang | |
| 2010/0022322 | A1 | 1/2010 | Huang | |

FOREIGN PATENT DOCUMENTS

| | | | |
|---|---|---|---|
| CN | 2163667 | Y | 5/1994 |
| CN | 2288744 | | 8/1998 |
| CN | 1332022 | A | 7/2000 |
| CN | 2438768 | | 7/2001 |
| CN | 2444645 | | 8/2001 |
| CN | ZL 02254450 | | 9/2002 |
| EP | 1 371 397 | | 12/2003 |
| FR | 2 731 402 | A3 | 9/1996 |
| GB | 2 264 062 | | 8/1993 |
| JP | 55-43008 | | 3/1980 |
| JP | 7-41731 | | 2/1995 |
| JP | 3081404 | | 8/2001 |
| JP | 2002-028264 | | 1/2002 |
| WO | WO 2005/115563 | A1 | 12/2005 |

OTHER PUBLICATIONS

Partial European Search Report, App. No. EP 03 25 5917, 2 pages-cites: 5,671,923; 4,765,856; US 2002/173371; US 2003/040384; and 5,571,050.
U.S. Appl. No. 10/167,216, filed Jun. 11, 2002, pending.
U.S. Appl. No. 10/608,598, filed Jun. 27, 2003, pending.
U.S. Appl. No. 10/785,379, filed Feb. 24, 2004, pending.
U.S. Appl. No. 10/875,035, filed Jun. 23, 2004, pending.
U.S. Appl. No. 11/029,328, filed Jan. 5, 2005, pending.
U.S. Appl. No. 11/062,046, filed Feb. 18, 2005, pending.
U.S. Appl. No. 11/131,832, filed May 18, 2005, pending.
U.S. Appl. No. 11/412,196, filed Apr. 25, 2006, pending.
U.S. Appl. No. 11/416,364, filed May 1, 2006, pending.
U.S. Appl. No. 11/413,411, filed Apr. 28, 2006, pending.
U.S. Appl. No. 11/438,808, filed May 22, 2006, pending.
U.S. Appl. No. 11/417,643, filed May 3, 2006, pending.
U.S. Appl. No. 11/417,623, filed May 3, 2006, pending.
U.S. Appl. No. 11/417,555, filed May 3, 2006, pending.
U.S. Appl. No. 11/417,401, filed May 3, 2006, pending.
U.S. Appl. No. 11/682,264, filed Mar. 5, 2007, pending.
U.S. Appl. No. 11/417,696, filed Mar. 5, 2006, pending.
The Random House Dictionary, Revised Edition, 1975, p. 1233, definition of skive.
U.S. Appl. No. 12/055,289, filed Mar. 25, 2008, pending (207C).
U.S. Appl. No. 11/838,670, filed Aug. 14, 2007, pending (217A).
U.S. Appl. No. 12,753,804, filed Apr. 2, 2010, pending.
U.S. Appl. No. 12/753,669, filed Apr. 2, 2010, pending.
U.S. Appl. No. 12/753,799, filed Apr. 2, 2010, pending.
U.S. Appl. No. 12/753,773, filed Apr. 2, 2010, pending.
U.S. Appl. No. 12/767,736, filed Apr. 26, 2010, pending, Aug. 25, 2010.
U.S. Appl. No. 12/848,052, filed Jul. 30, 2010, pending.

* cited by examiner

FIG. 10
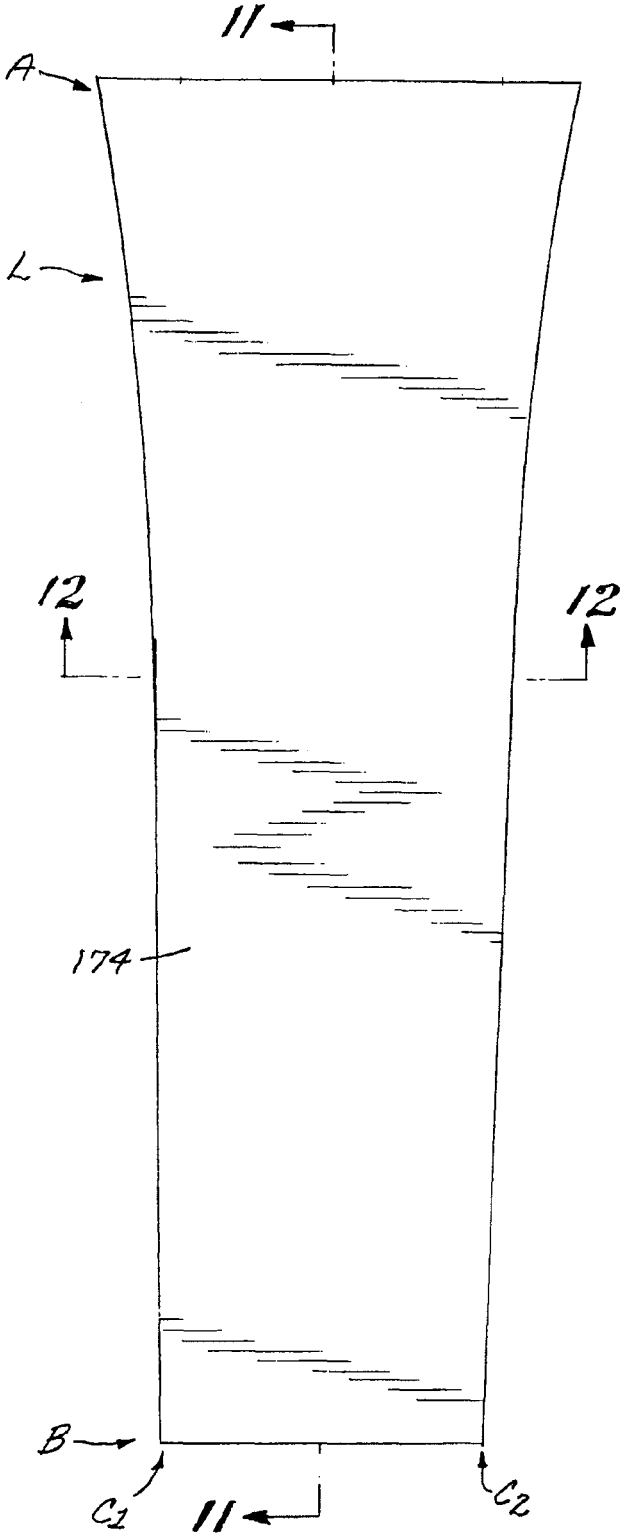
FIG. 11
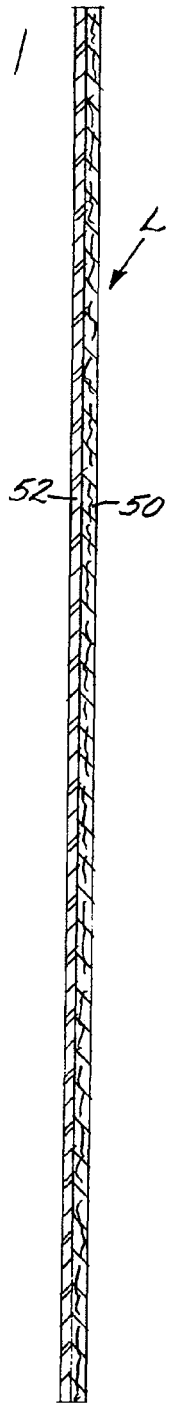
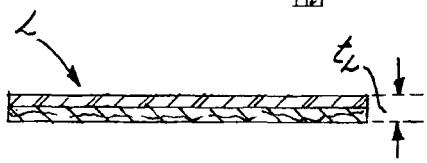
FIG. 12

150

152

144

112

GRIP HAVING A STABILIZED GRIPPING SURFACE

INCORPORATION BY REFERENCE

This application hereby incorporates by reference, in their entireties, U.S. Pat. Nos. 6,244,975, 6,627,027, 6,695,713, 6,843,732 and 6,857,971; U.S. Publication No. 2007/0004529; and U.S. patent application Ser. Nos. 11/438,808, filed May 22, 2006, 11/417,643, filed May 3, 2006, 11/417,696, filed May 3, 2006 and 11/417,623, filed May 3, 2006.

BACKGROUND OF THE INVENTION

1. Field of the Invention

This application relates to an improved grip, in particular an improved grip for use with golf clubs.

2. Description of the Related Art

Applicant has previously developed resilient grips which successfully reduce impact shock to the muscle and arm joints of a user and also provide a feeling of tackiness between a user's hands and the grip, improving upon prior art rubber grips. See, for example, U.S. Pat. No. 5,797,813 granted to Applicant on Aug. 25, 1998, U.S. Pat. No. 6,843,732 granted to Applicant on Jan. 18, 2005, and U.S. Pat. No. 6,857,971 granted to Applicant on Feb. 22, 2005.

Some of these earlier grips utilize a polyurethane-felt strip which is spirally wrapped around an underlisting sleeve that is slipped onto and adhered to a golf club shaft. The sides of the strips are formed with overlapping heat depressed recessed reinforcement edges. While such grips have proven satisfactory in reducing impact shock, the fabrication is labor intensive, particularly since the strip must be wrapped manually about the underlisting sleeve within specific pressure parameters. Additionally, it is difficult to accurately align the adjoining side edges of the strip as such strip is being spiraling wrapped about the underlisting sleeve. Further, these wrapped grips can become twisted during the wrapping process.

Applicant's U.S. Pat. No. 6,857,971 introduced a single panel to overcome the aforementioned disadvantages of existing spirally wrapped grips while providing the same resistance to shock afforded by such grips, as well as providing tackiness.

Applicant's U.S. Pat. No. 6,843,732 incorporated multiple segments into a single panel, which is then applied to the underlisting sleeve. Such a design facilitated embodiments of grips made according to the teachings of U.S. Pat. No. 6,843,732 to accommodate multiple color combinations.

Applicant's U.S. Patent Publication No. 2007-0004529 incorporated multiple two layer sheet pieces onto a backing layer. Such a structure facilitated embodiments of grips made according to the teachings of U.S. Patent Publication No. 2007-0004529 A1 to accommodate additional multiple color combinations.

Despite these improvements, there remains the opportunity for additional grip advances.

SUMMARY OF THE INVENTION

Embodiments of the present disclosure include a method of making a grip for use with a golf club that includes the steps of providing a tube having a first end, a second end and a support surface extending at least partially between the first and second ends; providing a raised portion on the tube having an exposed surface and a connecting surface extending between the support surface and the exposed surface; providing a layered sheet comprising an inner layer and an outer layer, the layered sheet configured to overlay the support surface and not the exposed surface; wrapping the layered sheet around the tube such that the layered sheet surrounds the support surface of the tube, leaving the exposed surface uncovered by the sheet; and adhering the inner layer of the layered sheet to the support surface, wherein an outer surface of the layered sheet and the exposed surface of the raised portion cooperate to define a gripping surface positioned to be gripped by a golfer.

Embodiments of the present disclosure include a method of making a grip for use with a golf club including the steps of providing a tube having a first end, a second end and a support surface extending at least partially between the first and second ends; providing a plurality of raised portions on the tube, each of the plurality of raised portions having an exposed surface and a connecting surface extending between the support surface and the exposed surface; providing a layered sheet comprising an inner layer and an outer layer, the layered sheet configured to overlay the support surface and not the exposed surfaces of the plurality of raised portions; wrapping the layered sheet around the tube such that the layered sheet contacts the support surface of the tube, so that at least two of the plurality of raised portions are separated by an outer surface of the layered sheet; and adhering the inner layer of the layered sheet to the support surface, wherein the outer surface of the layered sheet and the exposed surfaces of the plurality of raised portions cooperate to define a gripping surface positioned to be gripped by a golfer.

Embodiments of the present disclosure include a grip for use with a golf club including a tube having a first end, a second end and a support surface extending at least partially between the first and second ends. The grip further includes a raised portion on the tube having an exposed surface and a connecting surface extending between the support surface and the exposed surface. A layered sheet including an inner layer and an outer layer and configured to overlay the support surface and not the exposed surface is further included. The layered sheet is desirably wrapped about the tube such that the layered sheet surrounds the support surface of the tube while leaving the exposed surface uncovered. The inner layer of the layered sheet is desirably adhered to the support surface and an outer surface of said layered sheet and the exposed surface of the raised portion cooperate to define a gripping surface positioned to be gripped by a golfer.

Embodiments of the present disclosure include a grip for use with a golf club including a tube having a first end, a second end and a support surface extending at least partially between the first and second ends. The grip desirably further includes a plurality of raised portions on the tube, each of which having an exposed surface and a connecting surface extending between the support surface and the exposed surface. A layered sheet including an inner layer and an outer layer is provided wherein the layered sheet is configured to overlay the support surface and not the exposed surfaces of the plurality of raised portions. The layered sheet is desirably wrapped about the tube such that the layered sheet contacts the support surface of the tube and so that at least two of the plurality of raised portions are separated by an outer surface of the layered sheet The inner layer of the layered sheet is desirably adhered to the support surface such that the outer surface of the layered sheet and the exposed surfaces of the plurality of raised portions cooperate to define a gripping surface positioned to be gripped by a golfer.

BRIEF DESCRIPTION OF THE DRAWINGS

Further objects, features and advantages of the invention will become apparent from the following detailed description taken in conjunction with the accompanying figures showing illustrative embodiments of the invention, in which:

FIG. 10 is a front view of an embodiment of a layered sheet according to some embodiments;

FIG. 11 is a vertical cross-sectional view taken along the line designated 11-11 in FIG. 10;

FIG. 12 is a horizontal cross-sectional view taken along the line designated 12-12 in FIG. 10;

While the subject invention will now be described in detail with reference to the figures, it is done so in connection with the illustrative embodiments. It is intended that changes and modifications can be made to the described embodiments without departing from the true scope and spirit of the subject invention as defined by the claims.

DETAILED DESCRIPTION

Figure 1:
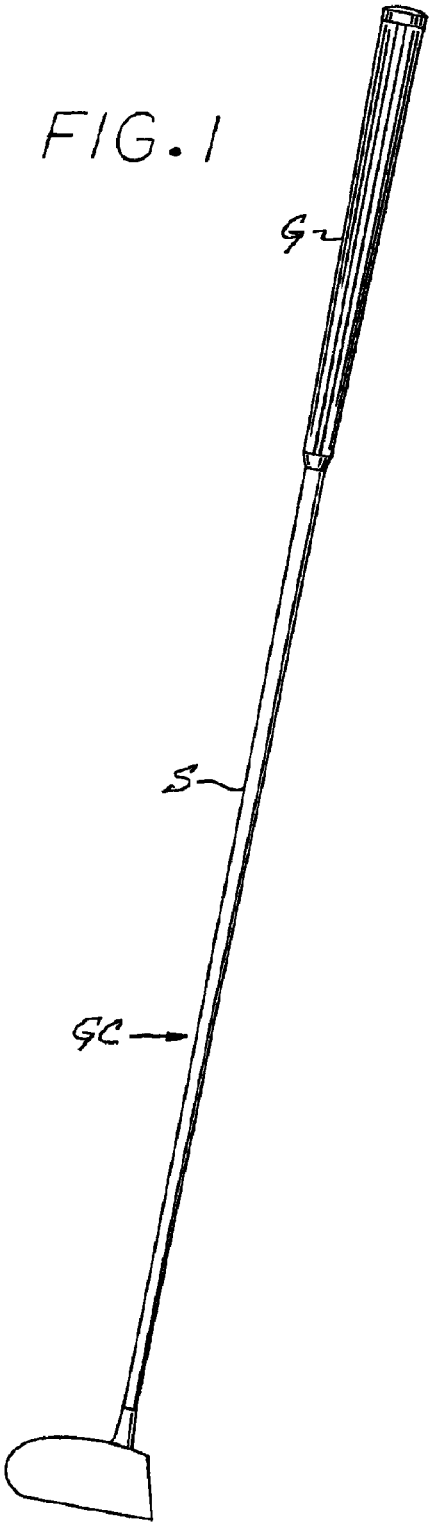
FIG. 1 is a perspective view of a golf club incorporating a grip according to some embodiments.
Figure 2:
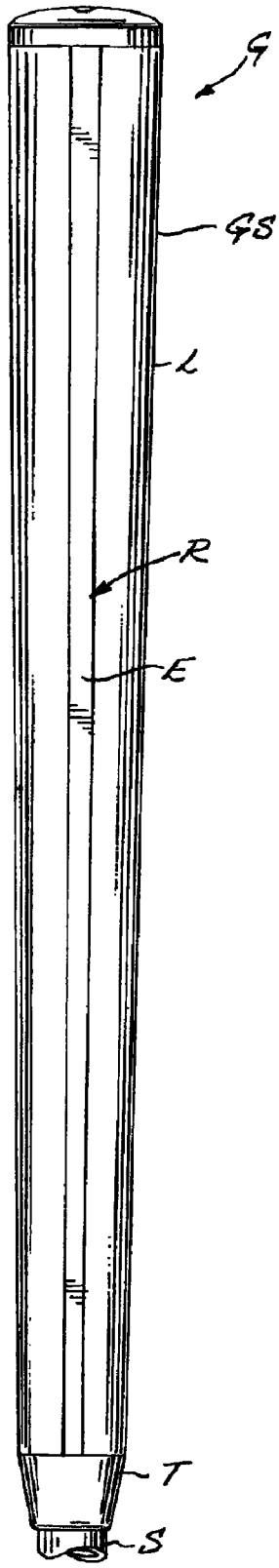
FIG. 2 is a rear view of a grip according to some embodiments.
Figure 3:
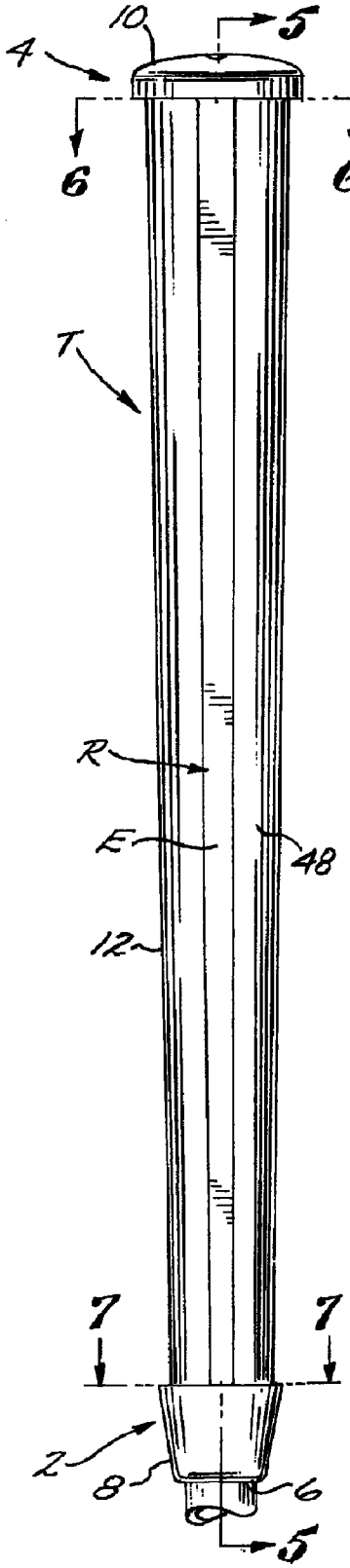
FIG. 3 is a rear view of a tube according to some embodiments.
Figure 4:
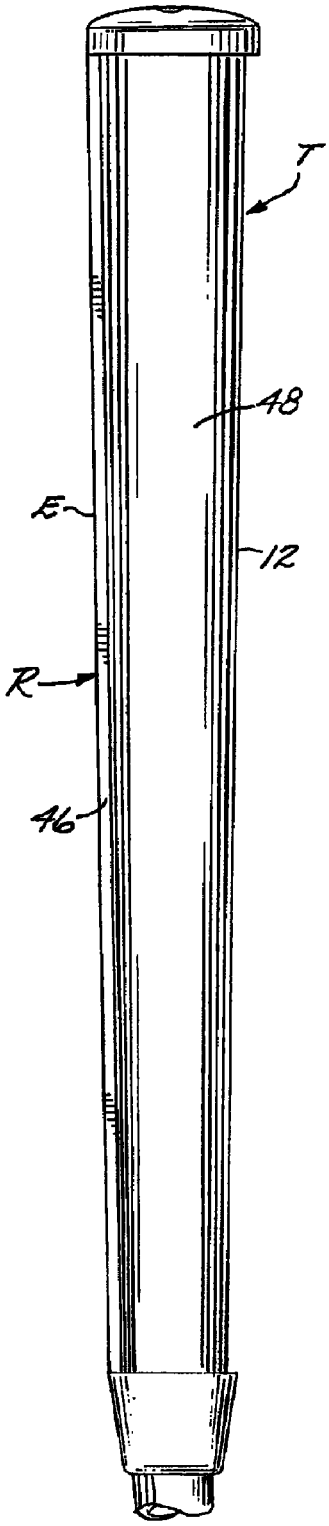
FIG. 4 is a side view of the tube shown in FIG. 3.

FIG. 1 shows one embodiment of a grip G attached to the shaft S of a golf club GC. FIG. 2 shows the grip G in greater detail.

Embodiments of grip G include a resilient mounting tube T and a layered member or sheet L wrapped about the tube T. The mounting tube T includes raised portions R which define one or more exposed surfaces E. Desirably tube T includes a tubular body 48 with one or more raised portions R. The grip defines a gripping surface GS. The gripping surface GS includes an outer surface of layered sheet L and an exposed surface E of the raised portion R of the tube T. (See, e.g., FIG. 2).

Figure 5:
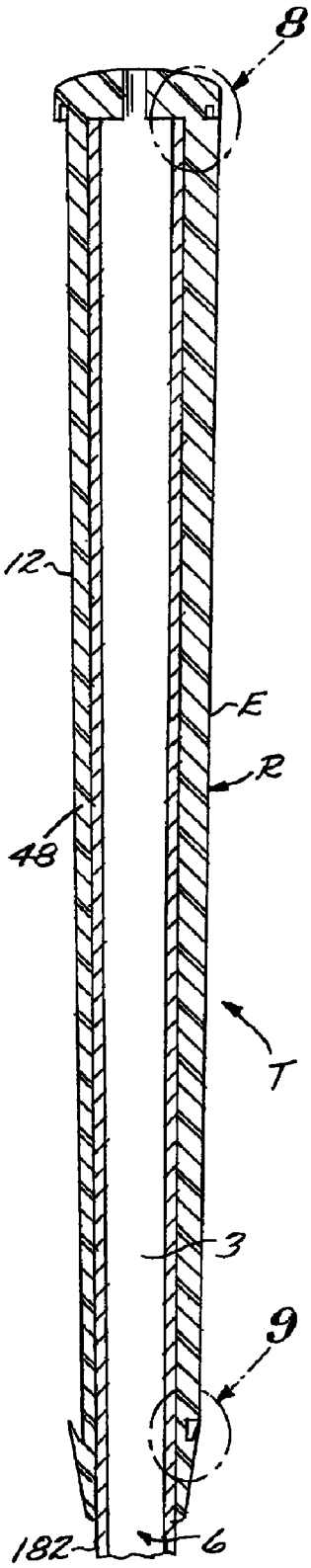
FIG. 5 is a vertical sectional view taken along line 5-5 of FIG. 3.

More particularly, referring to FIGS. 3 through 9, there is shown one embodiment of the resilient tube T on a mandrel 182 (FIG. 5). Tube T includes a first end 2 and a second end 4. Tube T further includes a hollow inner cavity 3 configured to correspond to the outer shape of the shaft GS of a golf club GC. An opening 6 and a ring 8 are formed at the first end 2 while the second end 4 of tube T is formed with a cover 10 substantially closing the second end 4. Tube T has a support surface 12 extending generally between cover 10 and ring 8. In some embodiments, tube T is formed of a resilient material such as a natural or synthetic rubber or plastic. For example, the rubber might include a mixture of synthetic rubber, for example EPDM (Ethylene Propylene Diene Monomer) and natural rubber. In some embodiments, the ratio of synthetic rubber to natural rubber is approximately 2 to 3. As known to those of skill in the art, tube T may be formed in a mold (not shown). In some embodiments, raised portion R is integrally formed on tubular body 48. In such instances, tubular body 48 and raised portion R may comprise the same material. If this is the case, forming the raised portion(s) R merely requires creating the inverse of the raised portion(s) R in the mold. In such cases, the material is selected to enhance the properties desired for the raised portion R while balancing the desired properties for tubular body 48. In some instances, it may be desired to control the durometer, tackiness, resistance to torque, durability, color, or other property of raised portion R to enhance certain properties of completed grip G.

Figure 7:
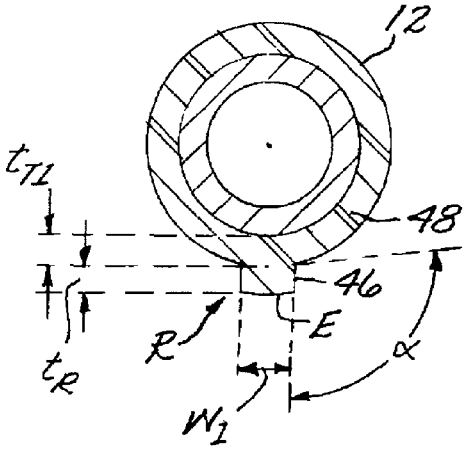
FIG. 7 is a horizontal sectional view taken along line 7-7 of FIG. 3.

As shown in FIG. 7, a connecting surface 46 forms an angle $\alpha$ with a line tangent to the intersection of connecting surface 46 of raised portion R and support surface 12 of tube T. Connecting surface 46 desirably extends between support surface 12 and exposed surface E. In some embodiments, angle $\alpha$ is in the range of approximately 75 and 105 degrees. In some embodiments, angle $\alpha$ is in the range of approximately 75 and 150 degrees. In some embodiments, angle $\alpha$ is approximately 90 degrees. Friction may be enhanced on raised portion R by forming ridges or valleys in various patterns (not shown) on surface E of raised portion R. In some embodiments, the patterns are formed as raised portion R is molded. In other embodiments, the patterns are applied by altering surface E of portion R after the molding process, such as by grinding surface E. In other embodiments, raised portion R is formed separately from tubular body 48 and is attached to tubular body 48 through bonding, adhesive or other mechanisms known to those of skill in the art to form tube T. Separately forming portion R may facilitate using a different material to form raised portion R than is used to form tubular body 48. In embodiments where multiple raised portions are desired (see, e.g., FIG. 43), separately forming one or more of the portions allows for a wide variety of different materials to be incorporated into the grip. It is also possible for some portions to be formed integrally with tubular body 48 while others are attached after tube T is molded.

Figure 6:
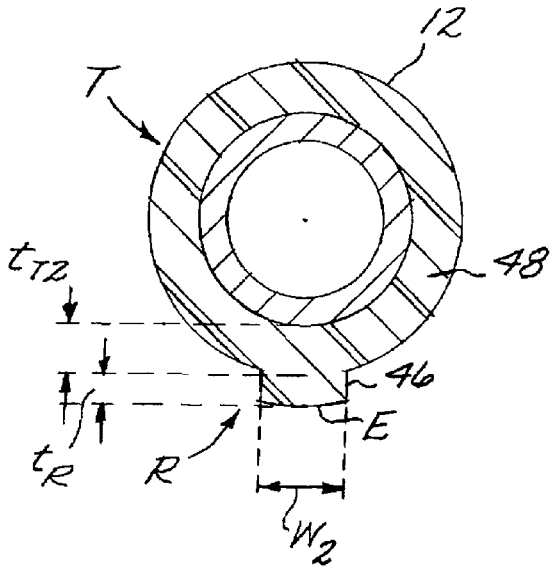
FIG. 6 is a horizontal sectional view taken along line 6-6 of FIG. 3.

Raised portion R is generally configured with a thickness $t_R$ while tubular body 48 is generally configured with a thickness $t_T$. The thickness $t_R$ of portion R may be generally constant along its entirety. In some embodiments, for example as shown in FIGS. 6 and 7, thickness $t_T$ of tubular body 48 varies along the length of tubular body 48 and the ratio of $t_R$ to $t_T$ also varies. In some embodiments, thickness $t_{T1}$ of tubular body 48 near first end 2 is larger than thickness $t_{T2}$ near second end 4. As shown in FIG. 7, the ratio of $t_R$ to $t_T$ near first end 2 is approximately 1 to 1. In some embodiments the ratio of $t_R$ to $t_T$ near first end 2 is in the range of approximately 2 to 1 to 1 to 2. Even larger ratios of up to approximately 1 to 3 and even up to approximately 1 to 4, or more, are also possible. As shown in FIG. 6, the ratio of $t_R$ to $t_T$ near second end 4 is approximately 1 to 1.5. In some embodiments the ratio of $t_R$ to $t_T$ near second end 4 is in the range of approximately 2 to 1 to 1 to 3. Even larger ratios of up to approximately 1 to 3 and even up to approximately 1 to 4, or more, are also possible.

Figure 43:
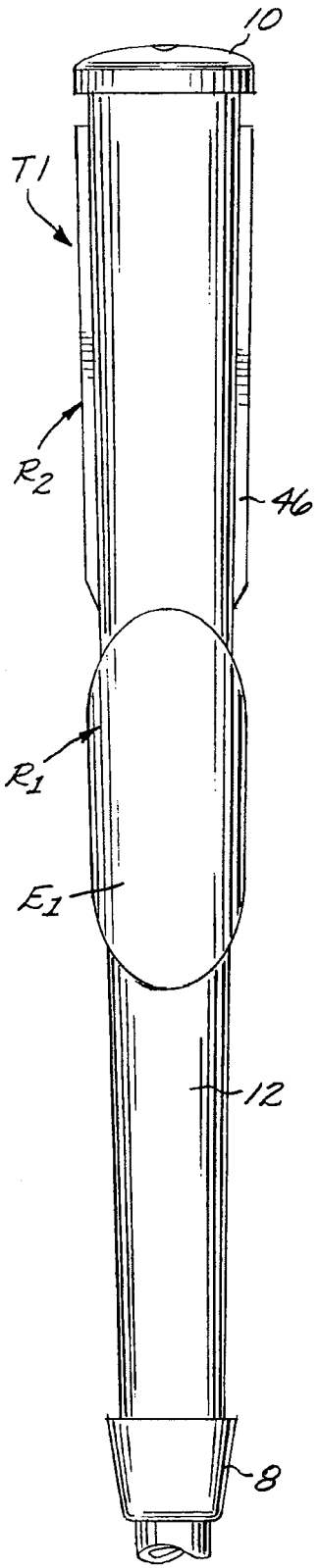
FIG. 43 a front elevational view showing a tube according to some embodiments.
Figure 44:
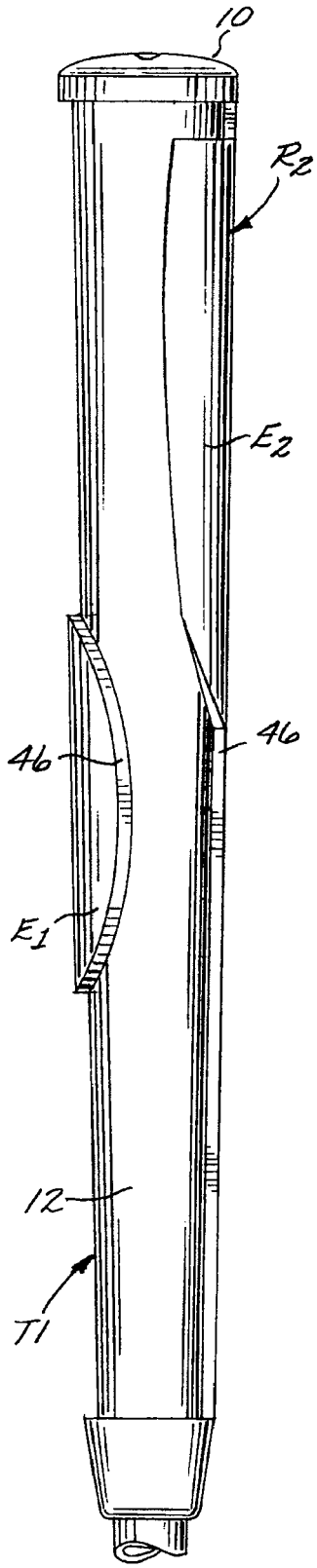
FIG. 44 is a side elevational view of the tube shown in FIG. 43.
Figure 45:
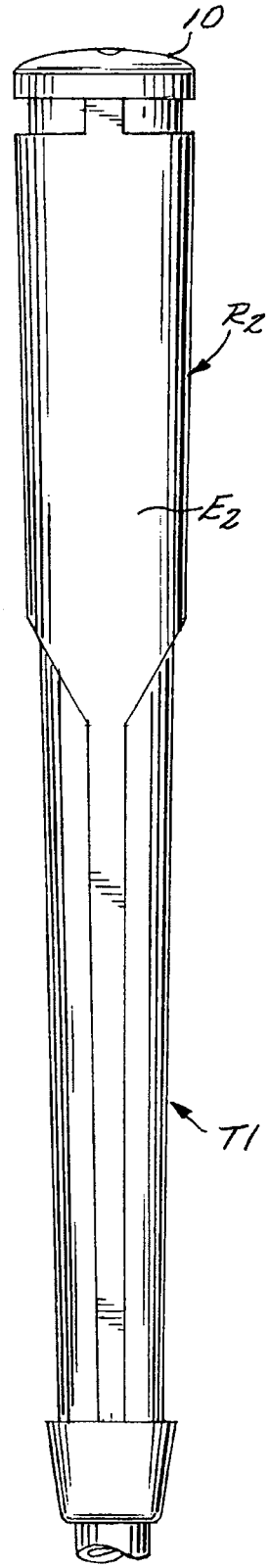
FIG. 45 is a rear elevational view of the tube shown in FIG. 43.

In some embodiments, for example as shown in FIGS. 2 through 9, raised portion R forms a bar having a width w and extends generally from first end 2 to second end 4 of tube T. In some embodiments, width $w_1$ near first end 2 is less than width $w_2$ near second end 4. In some embodiments, the ratio of $w_1$ to $w_2$ is approximately 1 to 1.5. In other embodiments, the ratio of $w_1$ to $w_2$ is in the range of approximately 1 to 1 to 1 to 3. Even larger ratios of up to approximately 1 to 4 and even up to approximately 1 to 5, or more, are also possible. In still other embodiments, the width w remains substantially constant along the length of tube T and the ratio of $w_1$ to $w_2$ is approximately 1 to 1. Though the width w of raised portion R is shown having a gradual increase along the length of tube T in the illustrated embodiment, other shapes and sizes are also possible for the raised portion. For example, raised portion R may have a varying width w that changes numerous times along the length of tube T. Alternatively, raised portion R may be shaped like an ellipse such that its width w varies from a minimum to a maximum and back down to a minimum distance moving along tube T. (See, e.g., FIG. 43). The bar shape of raised portion R is particularly useful to provide increased resistance to deformation forces, such as rotation torque, to the gripping surface GS while maximizing the use of the layered sheet L in the gripping surface GS. Increasing the size of raised portion R and changing its location, such as shown in FIG. 43, will allow increased manipulation of the properties of gripping surface GS. One or more raised portions R help stabilize the gripping surface GS while maintaining beneficial properties of the layered grip such as tackiness and shock absorption.

Figure 8:
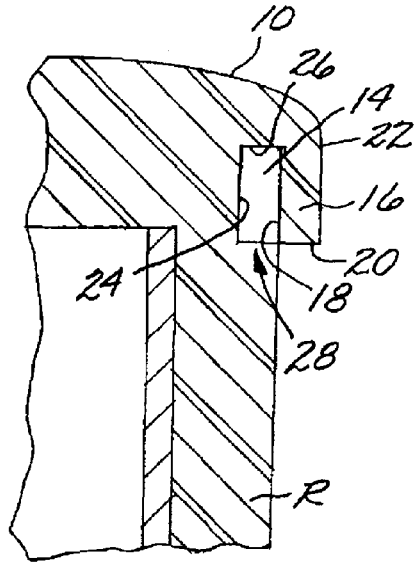
FIG. 8 is an enlarged view of the encircled area designated 8 in FIG. 5.

As shown in detail in FIG. 8, the underside of cover 10 is formed with a downwardly extending slot 14 which wraps substantially circumferentially around tube T. For convenience, as used herein the terms "downwardly," "downwards," etc. are used to refer to the direction extending from the second end 4 toward the first end 2 of the tube T. Similarly, the terms "upwardly," "upwards," etc. are used to refer to the direction extending from the first end 2 toward the second end 4 of the tube T. Similar conventions are used to refer to the other portions of grip G that are discussed herein, for example the layered sheet L discussed in greater detail below. Slot 14 is formed by a lip 16 extending downwardly from cover 10. Lip 16 defines an inner surface 18 facing support surface 12 of tube T, a lower surface 20 facing downwardly from cover 10, and an outer surface 22 facing away from support surface 12 of tube T. Downwardly extending lip 16 extends over a portion 24 of support surface 12 of tube T. The upper most portion of slot 14 is defined by an inner, upper, downwardly facing surface 26. Preferably, lip 16 is formed so as to resist flexing away from support surface 12 of tube T. Slot 14 is configured to receive, for example, the top region of layered sheet L.

In some embodiments, raised portion R has an upper region 28 disposed adjacent slot 14. In some embodiments, lower surface 20 of lip 16 is configured to extend just above upper region 28 of portion R. As shown in FIG. 8, in some embodiments, lower surface 20 of lip 16 is configured contact upper region 28 of portion R. In some embodiments, lower surface 20 of lip 16 is configured to overlap a small amount of raised portion R, enclosing upper region 28 of portion R within slot 14. In other embodiments, raised portion R extends further into slot 14 and, in some embodiments, upper region 28 is integrally formed with inner upper surface 26 of slot 14. In some embodiments, inner surface 18 of lip 16 is formed separate from raised portion R to facilitate insertion of, for example, the top region of a layered sheet. In some embodiments, lip 16 is integrally formed with portion R. In some such embodiments, slot 14 extends around only a portion of the circumference of tube T. As shown in FIG. 8, in some embodiments lip 16 may extend beyond exposed surface E of raised portion R to accentuate cover 10. In some such embodiments, inner surface 18 may be formed substantially flush with exposed surface E. Alternatively, outer surface 22 may be formed substantially flush with exposed surface E to form a substantially smooth interface.

Figure 9:
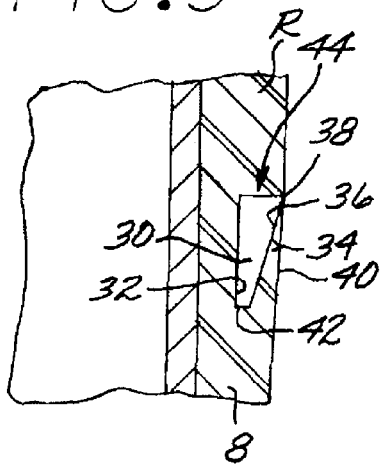
FIG. 9 is an enlarged view of the encircled area designated 9 in FIG. 5.
Figure 13:
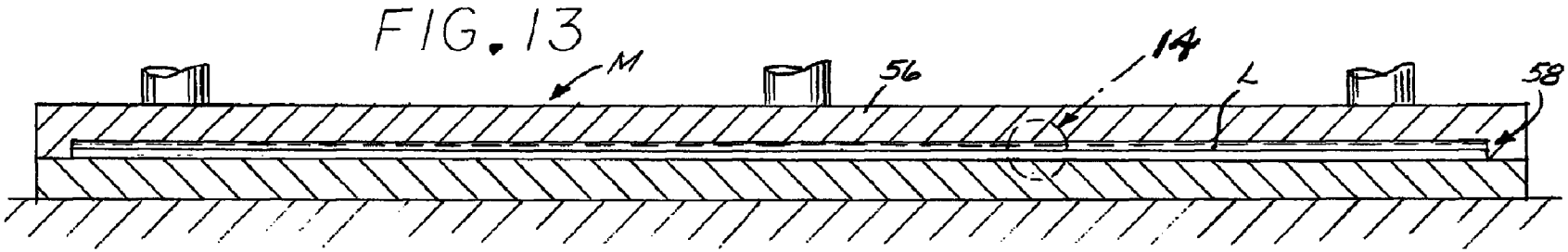
FIG. 13 is a horizontal cross-sectional view showing a mold which may be utilized in forming a layered sheet of a grip according to some embodiments.

Referring to FIG. 9, ring 8 of tube T may be formed with an upwardly extending slot 30 defined by a portion 32 of support surface 12 of tube T and lip 34 extending upwardly from ring 8 and preferably wrapping substantially circumferentially around tube T. Lip 34 defines an inner surface 36 facing tube T, an upper surface 38 facing upward from ring 8, and an outer surface 40 facing away from support surface 12 of tube T. Upwardly extending lip 34 extends over portion 32 of support surface 12 of tube T. The lower most portion of slot 30 is defined by an inner, lower, upwardly facing surface 42. Though lip 34 may flex outward from tube T, in many embodiments it resists remaining in a fully flexed position in which it lays flat, thereby fully exposing tube T support surface 12. In alternative embodiments, outer surface 40 tapers toward inner surface 36, or inner surface 36 tapers toward outer surface 40 such that upper surface 38 is comparatively narrow and in some embodiments is an annular point extending substantially circumferentially around tube T. Slot 30 receives, for example, the bottom region of a layered sheet.

In some embodiments, raised portion R has a lower region 44 disposed adjacent slot 30. In some embodiments, upper surface 38 of lip 34 is configured to extend just below lower region 44 of portion R. As shown in FIG. 9, in some embodiments, upper surface 38 of lip 34 is configured contact lower region 44 of portion R. In some embodiments, upper surface 38 of lip 34 is configured to overlap a small amount of raised portion R, enclosing lower region 44 of portion R within slot 30. In other embodiments, raised portion R extends further into slot 30 and, in some embodiments, lower region 44 is integrally formed with inner lower surface 42 of slot 30. In some embodiments, inner surface 36 of lip 34 is formed separate from raised portion E to facilitate insertion of, for example, the bottom region of a layered sheet. In some embodiments, lip 34 is integrally formed with portion R. To assist in installation of a layered sheet, in some embodiments tube T will be formed with centering notches (not shown) disposed on an outer surface of cover 10, ring 8 and/or both.

Referring now to FIGS. 10 through 38 are provided multiple types of layered sheets for use with tube T. Various aspects and attributes of the layered sheets may be combined from the disclosure below. Generally, layered sheet L has a thickness $t_L$ (FIG. 12) and includes an outer surface 174 and an inner layer 50 having its outer face bonded to the inner face of an outer layer 52. Outer layer 52, in some embodiments, comprises a polymer. In some embodiments, that polymer comprises polyurethane. Additional materials such as waterproofing coatings may be incorporated on outer surface 174. Similarly, other materials such as fabric meshes may be incorporated into outer layer 52. Inner layer 50 may be fabricated of a fibrous material including, for example, wool, polyester, nylon, or mixtures thereof. In certain embodiments, a nylon polyester fibrous material such as felt is used. During the manufacturing process, some of outer layer 52 may permeate inner layer 52. For example, when polyurethane is used in the outer layer and a fibrous material is used in the inner layer, some polyurethane may permeate the fibrous layer. In another embodiment, inner layer 50 may comprise a polymer, such as, for example, ethylene vinyl acetate (EVA).

Outer layer 52 may provide a cushioned grasp for a golfer's hands on a golf club and may enhance the golfer's grip by providing increased tackiness between the golfer's hands and the grip. Inner layer 50 may provide strength to outer layer 52 and serve as a means for attaching the bonded-together layered sheet L to the tube T.

The outer surface of inner layer 50 in some embodiments is bonded to the inner surface of outer layer 52. For purposes of this disclosure, the definition of bonding is intended to have a broad meaning, including commonly understood definitions of bonding, adhering, fixing, attaching, sewing, coupling, and gluing. As will be appreciated by those of skill in the art, the foregoing terms have their ordinary meaning. In some embodiments, the material used in the outer layer may penetrate some distance into the inner layer. When polyurethane is used in outer layer 52, such polyurethane is preferably coagulated to define pores, as shown, for example, in FIG. 26A. The polyurethane may be coagulated and bonded directly to inner layer 50 or may be first coagulated on an intermediary layer (not shown) and later attached to inner layer 50.

Layered sheet L may include centering notches (not shown) positioned at the top region A and the bottom region B of the layered sheet indicating a middle point between a first side region $C_1$ and a second side region $C_2$. Centering notches may assist in the application of layered sheet L to tube T to form grip G. As shown in FIG. 12, in some embodiments, side regions $C_1$ and $C_2$ are not skived, reducing the cost of manufacturing those embodiments.

Figure 15:
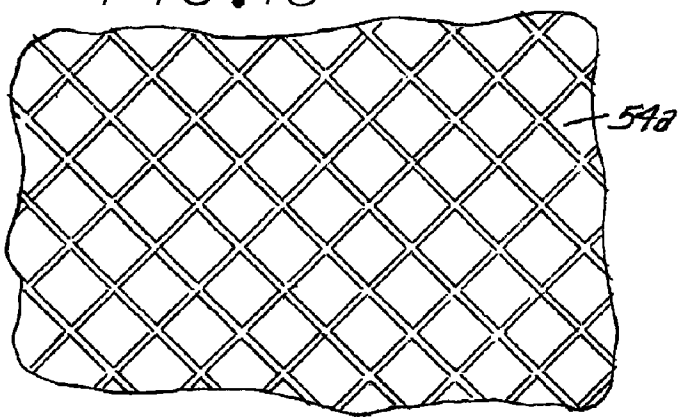
FIG. 15 is an enlarged view of an exemplary pattern that may be formed by the mold shown in FIGS. 13 and 14.
Figure 14:
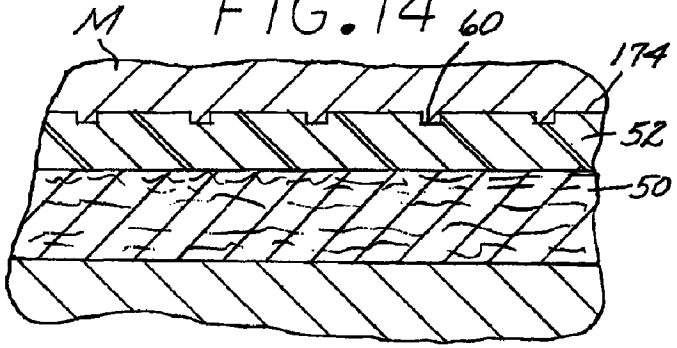
FIG. 14 is an enlarged view of the encircled area designated 14 in FIG. 13.
Figure 16:
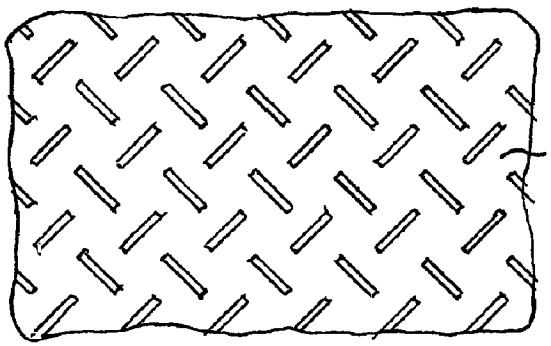
FIG. 16 is an enlarged view of another exemplary pattern that may be formed by the mold shown in FIGS. 13 and 14.
Figure 17:
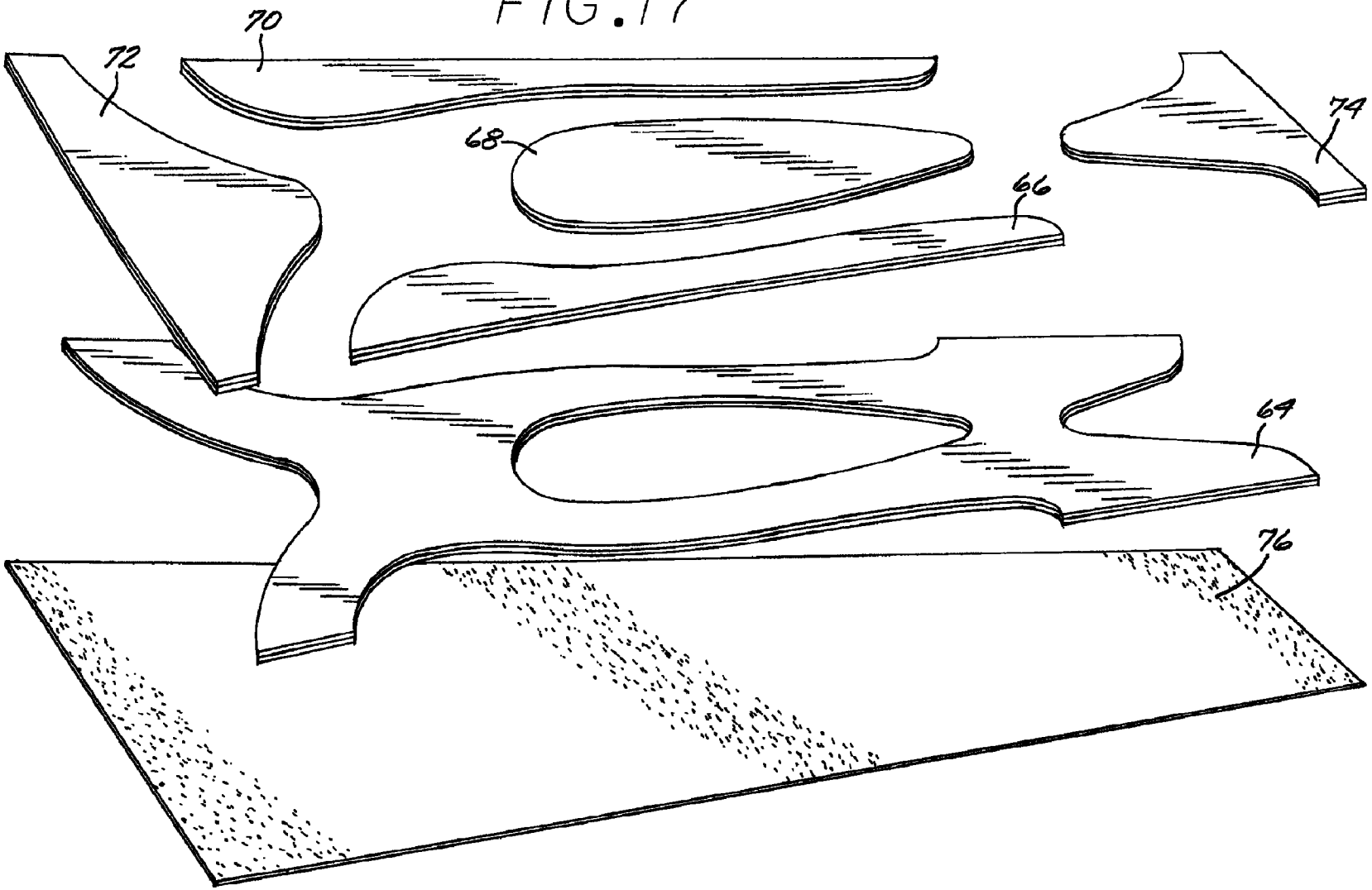
FIG. 17 is a perspective view of a multi-sectional sheet being coupled to a backing sheet according to some embodiments.

Referring now to FIGS. 13 through 16, there is shown a mold M which is utilized to form a friction enhancing pattern 54 as known to those of skill in the art. Friction enhancing pattern 54 may take any of a number of forms or combinations thereof. For example, two such patterns 54*a* and 54*b* are shown in FIGS. 15 and 16, respectively. In alternative embodiments, mold M forms logos, designs, insignias and other marks (not shown) in outer layer 52. Mold M in one embodiment includes a heated platen 56 formed with a cavity 58. Platen 56 is provided with depending protrusions 60 that engage outer surface 174 of layered sheet L so as to form depressed friction enhancing pattern 54, as seen in FIG. 14. Friction enhancing pattern 54 may also be applied to the other layered sheets described below.

In alternative embodiments, other patterns may be formed on or in outer layer 52. These patterns may also incorporate stamped visual indicia, including designs or logos, on layered sheet L. In some embodiments, stamped visual indicia is ink stamped onto outer layer 52 using a suitable ink known to those of skill in the art. The ink in some implementations is waterproof, heat resistant and formulated to resist degradation when coming into contact with a lubrication fluid or solvent used to apply completed grip G over the end of golf club shaft CS (FIG. 1). It is to be understood that the figures herein presented are representative only and many other patterns and stamps may be used with embodiments of the grip disclosed herein.

Though not shown in the figures, a multi-segment single panel as disclosed in U.S. Pat. No. 6,843,732, incorporated herein in its entirety, may also be applied to tube T as described herein. In some embodiments, raised portion R on tube T facilitates attachment of the multi-segment single panel disclosed in the '732 patent to tube T without first skiving some or all of the side regions of the panel.

FIGS. 17 through 20 depict additional embodiments of a layered sheet L1 wherein a layered sheet 64 includes cutouts corresponding to layered inserts 66, 68, 70, 72, 74. Sheet 64 and inserts 66, 68, 70, 72, 74 are arranged on a backing sheet 76. In one embodiment, sheet 64 is cut, sliced, and or otherwise removed and separated from a larger starting sheet of material (not shown). Sheet 64 may also be formed according to other practices well known to those of skill in the art. Inserts 66, 68, 70, 72, 74 are formed by similar means.

Sheet 64 and inserts 66, 68, 70, 72, 74 may include materials of one or more differing properties and may be positioned to maximize the benefit of one or more of those properties. For example, there may be locations of increased wear on grip G during use. Cutouts may be strategically placed in these areas of increased wear and corresponding inserts may be placed in those areas. These inserts may include materials of increased strength, durability, durometer, etc., which may make them better suited to absorb the forces imparted to those areas of the grip. As those of skill in the art will appreciate from the foregoing, these inserts may have different levels of tackiness. As will be further understood, the inserts could be selected based on tackiness. In some embodiments where it would be advantageous to have even greater durability in certain areas, raised portion R may be formed to fill these areas, replacing one or more of the inserts.

It also may be desirable to include certain areas of a different color. In such an instance, cutouts may be formed and correspondingly shaped inserts may be used in those locations with different colors. In addition, sheet 64 or inserts 66, 68, 70, 72, 74 may include one or more friction enhancing patterns such as those shown in FIGS. 15 and 16 prior to being formed into layered sheet L1, or may be manipulated to include these patterns after being formed into layered sheet L1. In the earlier case, the patterns may be formed when the components are cut from the larger starting sheets or they may be formed in a separate step. These different colors may be used on cutouts with the same physical properties. Cutouts having the same physical properties may also share the same color.

In some embodiments, backing sheet 76 is an adhesive coated plastic. The adhesive used is generally strong enough to maintain the relative positions of sheet 64 and inserts 66, 68, 70, 72, 74; however, it is generally removable prior to bonding the layered sheet L1 to tube T. In some embodiments, backing sheet 76 is removed after sheet 64 and inserts 66, 68, 70, 72, 74 have been joined. Alternatively, backing sheet 76 may comprise a thin layer of material intended to remain in grip G. For example, a thin sheet of fibrous material or other strength material may be used and permanently joined or bonded to the backs of sheet 64 and inserts 66, 68, 70, 72, 74.

Figure 18:
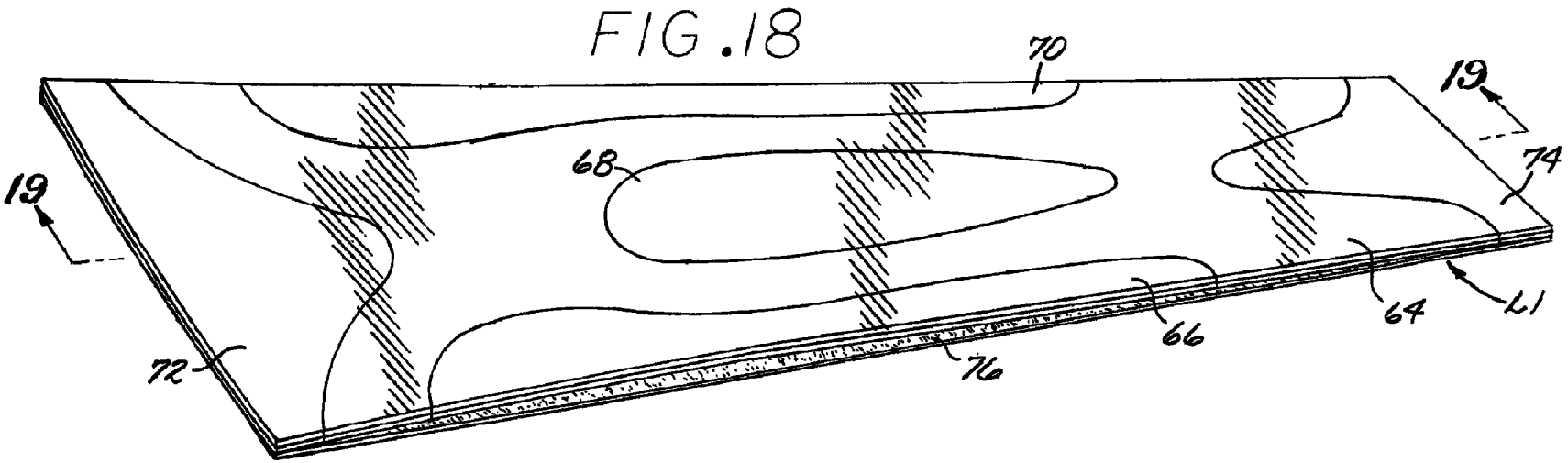
FIG. 18 is a perspective view of a layered sheet of a grip according to some embodiments.
Figure 19:
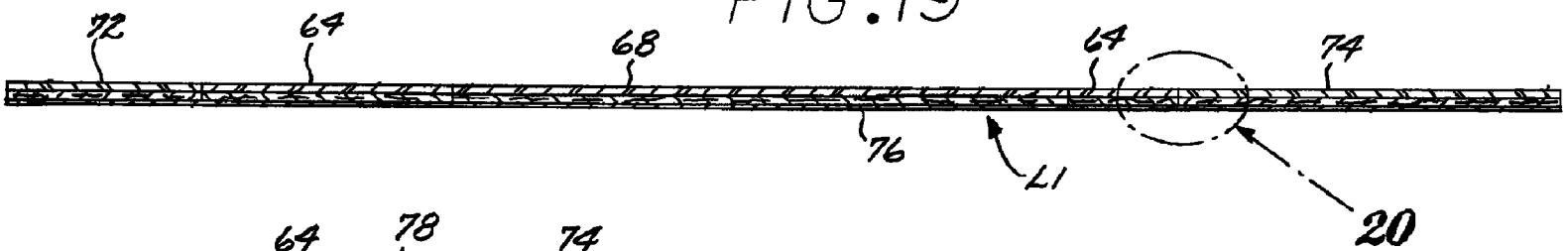
FIG. 19 is a cross-sectional view taken along the line 19-19 in FIG. 18.
Figure 20:
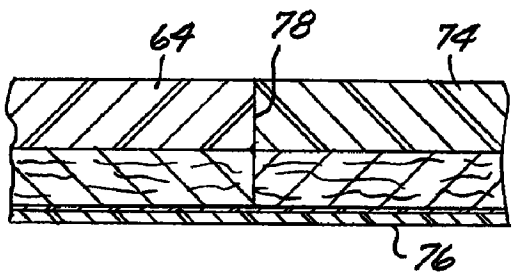
FIG. 20 is an enlarged view of the encircled area designated 20 in FIG. 19.
Figure 21:
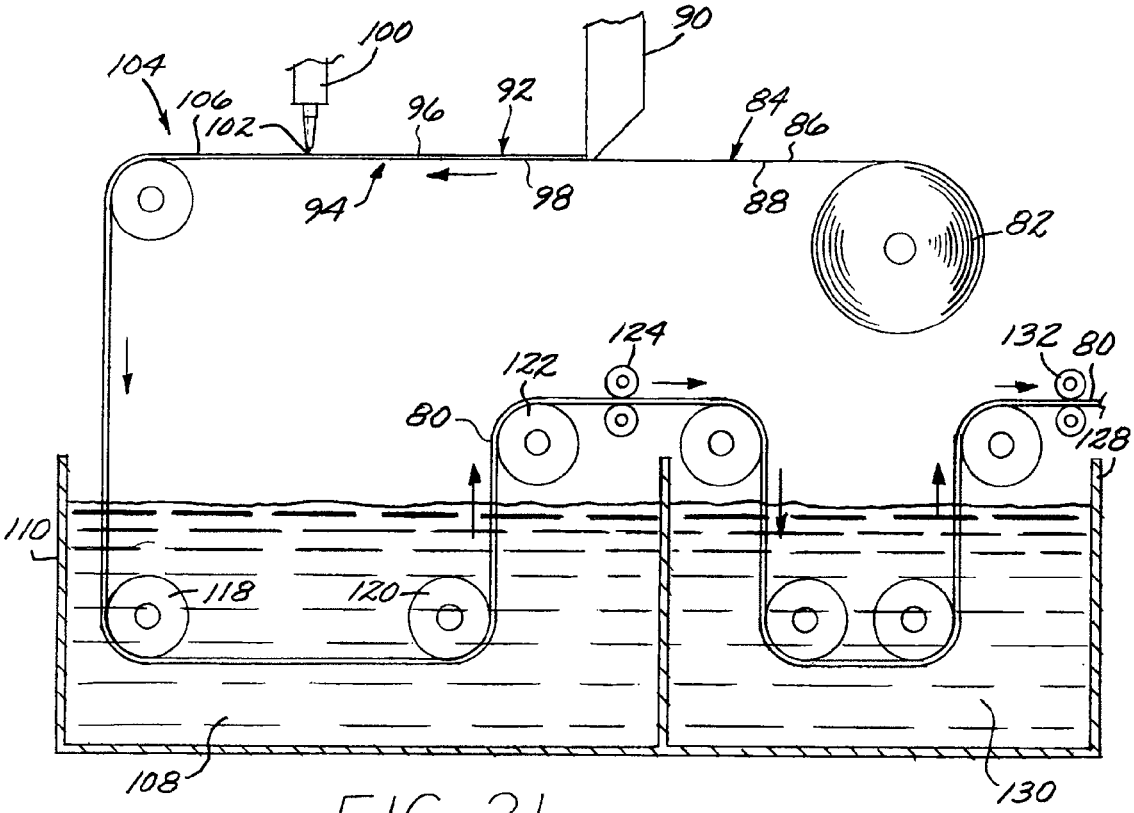
FIG. 21 is a schematic view showing a portion of a method of making a sheet according to some embodiments.
Figure 22:
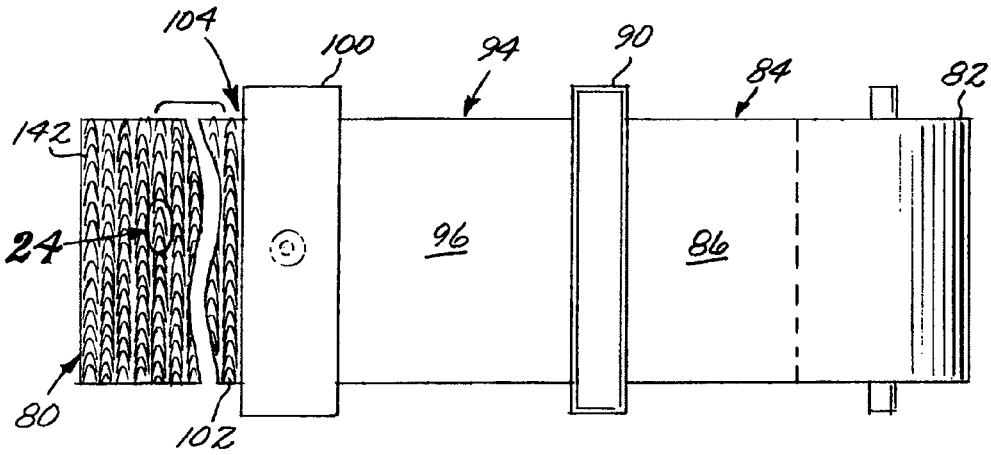
FIG. 22 is a top view of a portion of the schematic view shown in FIG. 21.

As shown in FIG. 18, after arranging sheet 64 and inserts 66, 68, 70, 72, 74 onto backing sheet 76, they are secured such that their sides are in contact with each other to form intersections 78. These intersections 78 may include one or more adhesives to bond or join the sides of inserts 66, 68, 70, 72, 74 to the sides of sheet 64. If backing layer 76 is intended to be incorporated into the grip, an adhesive with a chemical formula toluene ($CH_5CH_3$), ethyl acetate ($C_4H_8O_2$), methyl ethyl ketone ($C_4H_8O$), and acetone ($C_3H_6O$) may be used between the backs of sheet 64 inserts 66, 68, 70, 72, 74 and the top of backing layer 76 and along at least a portion of the intersections 78. At least a portion of the intersection between the outer layers may be a polymer deposit. If the outer layers comprise polyurethane, the deposit may also comprise polyurethane.

In some embodiments, layered sheet L1 is placed in a mold similar to mold M described above to impart a friction enhancing pattern on outer surface 174 thereof. In addition, the outer portion of one or more of intersections 78 of layered sheet L1 may be heated by corresponding depending projections from the mold. Such heating can heat the outer surface of sheet 64 and inserts 66, 68, 70, 72, 74 to bond the same to each other. Such a technique is particularly effective in coupling sheet 64 to inserts 66, 68, 70, 72, 74 when the outer layer of each comprises polyurethane. In some embodiments, deposits of adhesive may be inserted along the intersection on the surface of the components of the layered sheet or within the intersections to enhance the effectiveness of the bond between sheet 64 and inserts 66, 68, 70, 72, 74.

Referring to FIGS. 21 through 30, there is shown a method of forming a sheet 80 having an inner layer and an outer layer that can be shaped into another layered sheet L2. Referring to the upper right-hand portion of FIG. 21, there is shown a supply roll 82 of substrate 84. Substrate 84 has a top surface 86 and a bottom surface 88. In some embodiments, substrate 84 includes a fibrous material, for example felt or other fabrics, which may include wool, polyester, nylon, or mixtures thereof. In one embodiment, substrate 84 comprises a fabric including nylon and polyester. From the supply roll 82, substrate 84 is moved horizontally to the left below a first polyurethane dispensing machine 90. The first dispensing machine 90 preferably continually deposits a first region of liquid polyurethane 92, for example polyester or polyether dissolved in dimethyl formahide (DMF), onto top surface 86 of substrate 84 to form first web 94. The first dispensing machine 90 preferably uses a nozzle, sprayer or the like to deposit the first polyurethane region 92 and preferably uses a blade to control the thickness of the first polyurethane region 92. First polyurethane region 92 has a top surface 96 and a bottom surface 98.

As first web 94 continues to the left from first dispensing machine 90, a second polyurethane dispensing machine 100 deposits a second liquid polyurethane region 102 onto at least a portion of top surface 96 of first polyurethane region 92 to form a second web 104. Second polyurethane region 102 has a top surface 106. Second web 104 is then moved into a water bath 108 contained in a first tank 110. As second web 104 is immersed in water bath 108, polyurethanes 92 and 102 will coagulate so as to form a coagulated region 112 on substrate 84. Coagulated region 112 and substrate 84 cooperate to form sheet 80 wherein the coagulated region forms the outer layer and the substrate forms the inner layer. Coagulated region 112 has a top surface 144 and a bottom surface 114.

Figure 26A:
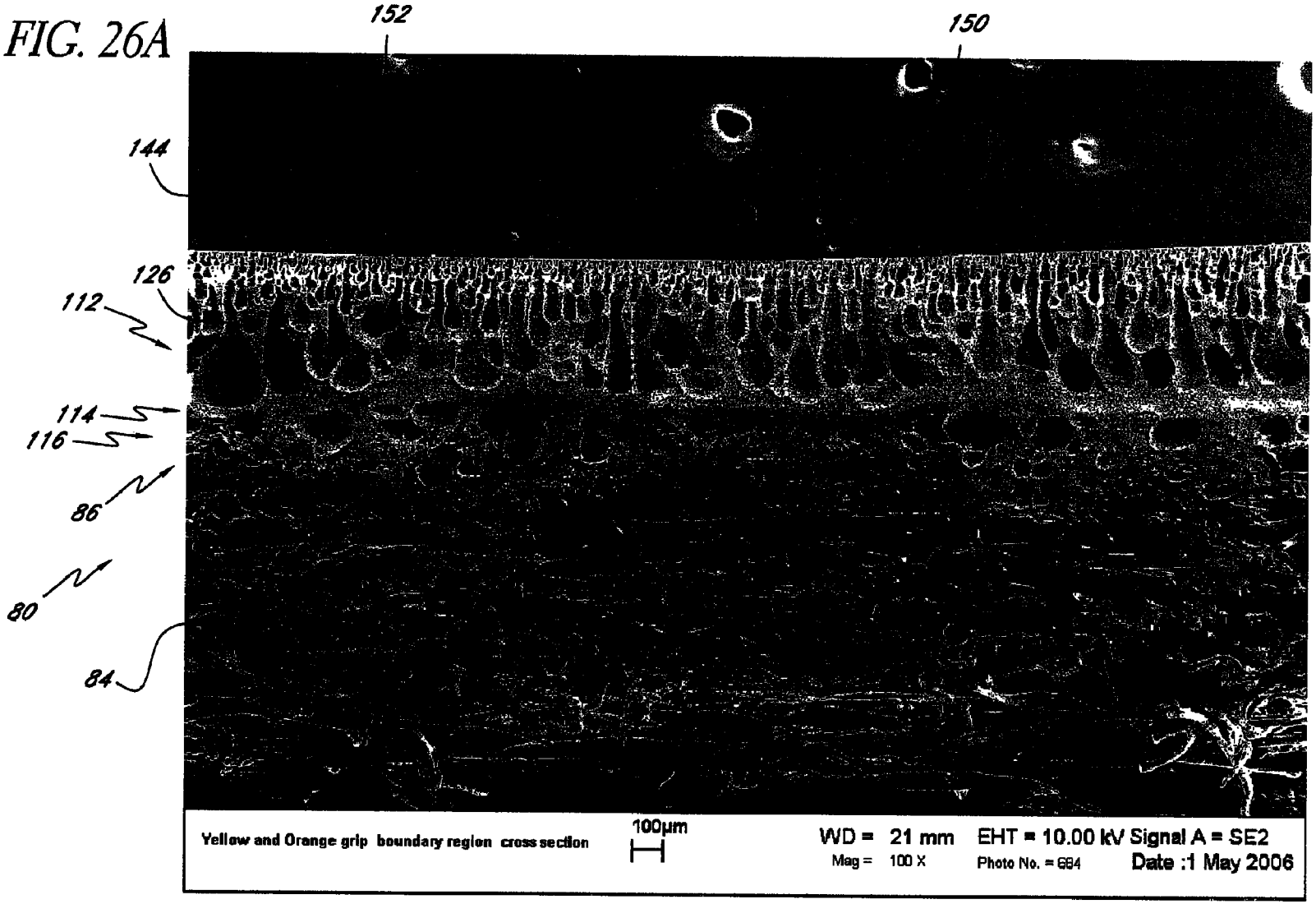
FIG. 26A is a SEM image at 100 times magnification of a cross-section of a sheet made according to a method of some embodiments.

As is known, the coagulation time of the polyurethane will be determined by the desired thickness of coagulated region 112, with a thin region requiring less time to coagulate than a thick region. In some embodiments, the coagulation process bonds bottom surface 114 of coagulated region 112 to top surface 86 of substrate 84 so as to fix coagulated region 112 to substrate 84. This bond interface 116 is shown in FIG. 26A. A pair of rollers 118 and 120 are positioned within tank 110 to carry sheet 80 horizontally and then upwardly out of water bath 108 over roller 122. Sheet 80 is then moved horizontally to the right between a pair of squeezing rollers 124. These squeezing rollers 124 compress sheet 80 so as to force a major portion of the DMF disposed within pores 126 downwardly through substrate 84. Referring to FIG. 26A, the bottom end of a sufficient number of the pores are in contact with top surface 86 of substrate 84 to permit fluid flow from the pores through substrate 84. Referring again to FIG. 21, sheet 80 is then moved downwardly through one or more cleaning water bath tanks 128 (only one of which is shown), wherein the temperature of the water is sufficiently high to displace more DMF from the pores, with such DMF being replaced by water 130 contained in tank 128. From tank 128, sheet 80 passes through another pair of squeezing rollers 132 to squeeze more of the DMF out of the pores to be replaced with water 130. In practice, it may be necessary to utilize four or five cleaning baths to remove a desired amount of DMF from the pores. From the last water bath, sheet 80 is passed through a heating chamber (not shown) which drives out any water remaining within pores 126 so that such water is replaced by air.

In another embodiment (not shown), substrate 84 includes a flexible temporary support for the polyurethane during the wet coagulation process described above. Such a temporary support would be configured to be removed from bottom surface 114 of coagulated polyurethane region 112 after sheet 80 is formed. In such an embodiment, bond interface 116 is desirably relatively weak to facilitate separation of coagulated region 112 from substrate 84. One temporary support includes a smooth, flexible nylon cloth and is available from the Ho Ya Electric Bond Factory, Xin Xing Ind. Area. Xin Feng W. Rd., Shi Jie Town Dong Guan City, Guan Dong Province, China. Other materials include fluid-permeable textiles such as cotton or a synthetic cloth such as polyester. Generally, the temporary support would have the fluid-passing characteristics and smooth top surface of nylon cloth allowing the DMF and water to be squeezed out of the polyurethane pores and allowing the coagulated polyurethane to be readily stripped off such temporary support. Removing substrate 84 from coagulated polyurethane region 112 provides for use of coagulated polyurethane region 112 alone or provides the opportunity to use an alternative substrate. For example, it is possible to replace the fabric substrate with a polymer substrate such as ethylene-vinyl acetate (EVA). The EVA substrate may include an adhesive coating to bond the EVA substrate to coagulated polyurethane region 112. EVA having an adhesive coating covered by a protective paper is sold by the aforementioned Ho Ya Electric Bond Factory.

Figure 23:
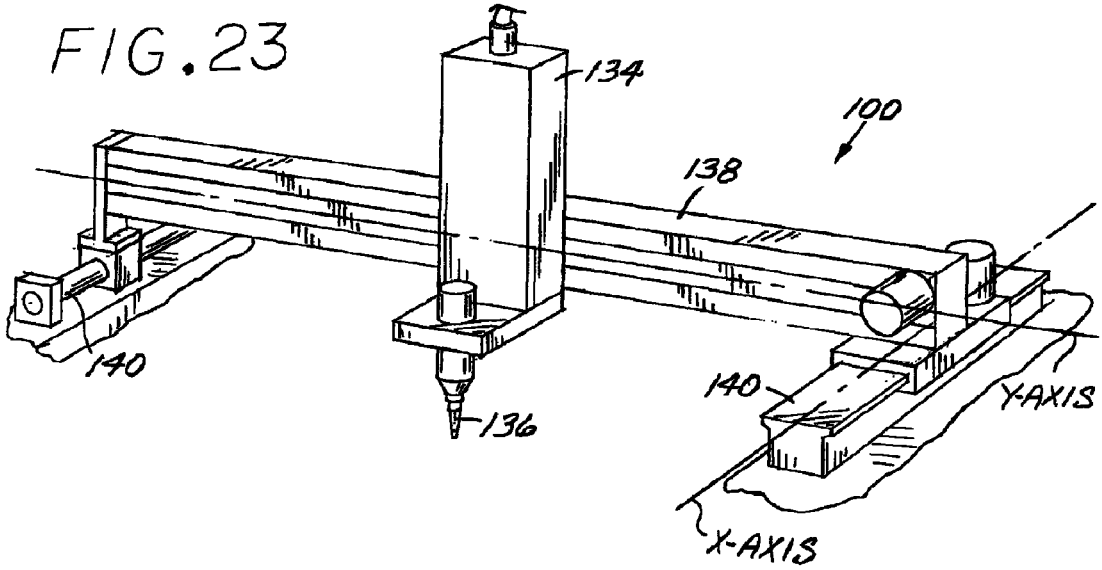
FIG. 23 is a schematic view showing an apparatus for use in a portion of a method of making a sheet according to some embodiments.

Referring now to FIG. 23, a schematic illustration of second dispensing machine 100 is shown. In FIG. 23, dispensing machine 100 includes a first housing 134 having a first dispensing nozzle 136. Housing 134 is connected to perpendicular rail 138 extending along the Y axis as illustrated. Rail 138, in turn, is connected to parallel rails 140 extending along the X axis as illustrated. Dispensing machine 100 is configured to allow first web 94 of substrate 84 and first polyurethane region 92 to pass beneath nozzle 136, preferably at a constant pace, along the X axis (see FIGS. 21 and 22). First polyurethane region 92 may provide a base region for the second polyurethane region 102. In some regions, second polyurethane region 102 may extend completely through first polyurethane region 92 to be in contact with substrate 84. Dispensing machine 100 is preferably further configured to move nozzle 136 in one or both of the X and Y directions. In addition, nozzle 136 may be configured to start and stop depositing second polyurethane 102 as desired. The movement of nozzle 136 in the X and Y directions and the start/stop feature of the nozzle 136 provides for the ability to create a unique appearance which may include random or semi-random patterns 142 in second web 104 and, in turn, in sheet 80 (see FIG. 22). In other embodiments, web 94 is moved beneath a stationary nozzle 136 to create a pattern. For example, nozzle 136 could be fixed along the X axis and the pace with which web 94 is moved under nozzle 136 can be varied. Similarly, nozzle 136 could be fixed along the Y axis and web 94 can be shifted along the Y axis instead. Alternatively, nozzle 136 can be moved in both directions.

In other embodiments (not shown), dispensing machine 100 may include two, three or more nozzles for dispensing third, forth, etc. polyurethane regions. Such additional nozzles may be included in the same housing, separate housings or a combination thereof. It is also possible to include additional dispensing machines on separate rails to introduce still further variation in the application of the polyurethane regions.

Figure 24:
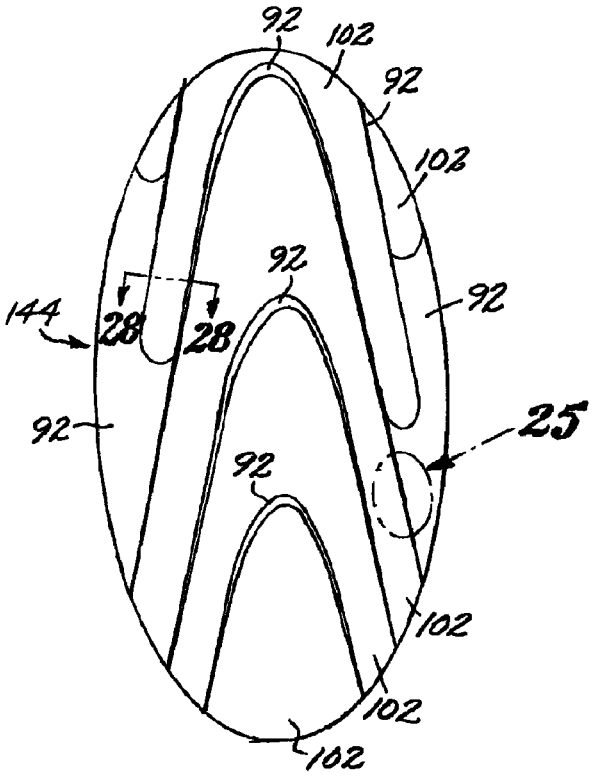
FIG. 24 is an enlarged view of the encircled area designated 24 in FIG. 22.

Referring now to FIG. 24, there is shown an enlarged view of pattern 142 formed in coagulated polyurethane region 112 of sheet 80. Generally, top surface 144 of coagulated region 112 includes pattern 142 because first polyurethane 92 and second polyurethane 102 each include at least one contrasting characteristic. In the illustrated embodiment, the contrasting characteristic is color. However, other contrasting characteristics, or combinations thereof, could be incorporated to create the pattern such as contrasting durometers or levels of tackiness. In the figures, first polyurethane 92 defines a first color 146 and second polyurethane 102 defines a second color 148. As shown in greater detail in FIG. 25, pattern 142 on top surface 144 of coagulated region 112 includes a first region 150 and a second region 152 defined by first color 146 of first polyurethane 92 and second color 148 of second polyurethane 102, respectively.

As described above, the two polyurethanes 92 and 102 are coagulated onto substrate 84 in first water bath 108. The application of second polyurethane 102 onto a portion of top surface 96 of first polyurethane 92 prior to coagulation allows for the polyurethanes to mix and integrate below top surface 96 of the first polyurethane region such that coagulation of the polyurethanes forms the single coagulated region 112 (see FIGS. 26A and 26B). Despite the mixing of the two polyurethanes prior to coagulation, and the integration of the two polyurethanes during coagulation, each of the polyurethanes substantially maintains its original characteristics. The contrast in one or more characteristics of the polyurethanes creates pattern 142. Though the characteristics remain substantially distinct, there may be some blending along the interface of the two polyurethanes.

In the illustrated embodiment, top surface 96 of first polyurethane region 92 cooperates with top surface 106 of second polyurethane region 102 to form substantially smooth top surface 144 of coagulated region 112. Contrasting colors 146 and 148 on surface 144 cooperate to create pattern 142. If the first polyurethane is red and the second polyurethane is white, the process discussed above would result in a coagulated polyurethane region with distinct red and white regions, rather than a single blended pink region. Though the contrasting characteristics of first 92 and second 102 polyurethanes remain substantially distinct, the polyurethane structure below top surface 144 is preferably seamless between the different polyurethanes with a preferably continuous pore structure throughout (see FIGS. 26A and 26B).

Figure 25:
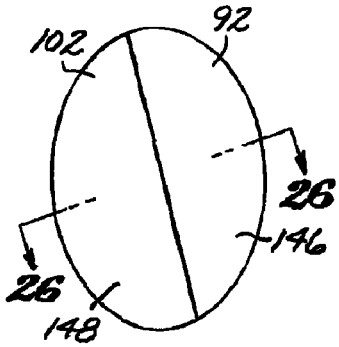
FIG. 25 is an enlarged view of the encircled area designated 25 in FIG. 24.

FIG. 26A is a 100 times magnification of a cross-section of a sample coagulated sheet 80 taken along the line 26-26 in FIG. 25. FIG. 26A shows substrate 84, in the sample a polyester nylon fabric, with its top surface 86 bonded to bottom surface 114 of coagulated polyurethane region 112 along bond interface 116. Top surface 144 is generally smooth. The structure is desirably substantially seamless on both the top surface 144 between first region 150 and second region 152 and substantially seamless inside coagulated region 112 where first polyurethane 92 interfaces with second polyurethane 102. It is apparent that the structure is not just seamless and not just coagulated, but the two polymers polymerize with each other to form coagulated region 112. Accordingly, in the illustrated embodiment coagulated region 112 is a polymerized region. Coagulated region 112 preferably includes a plurality of generally vertically extending pores 126, top surface 144, and bottom surface 114. Pores 126 generally form substantially throughout coagulated region 112 including in the regions where first polyurethane 92 interfaces with second polyurethane 102 between top 144 and bottom 114 surfaces. Though polyurethane is preferred to form the coagulated region, other liquid polymers having contrasting characteristics may be used. Generally, the polymers will be combined while in their liquid states and allowed to polymerize together. As the polymers polymerize together, the structure of polymerized region 112 will preferably be seamless while maintaining the contrasting characteristics at least on outer surface 144 of polymerized region 112.

Figure 26B:
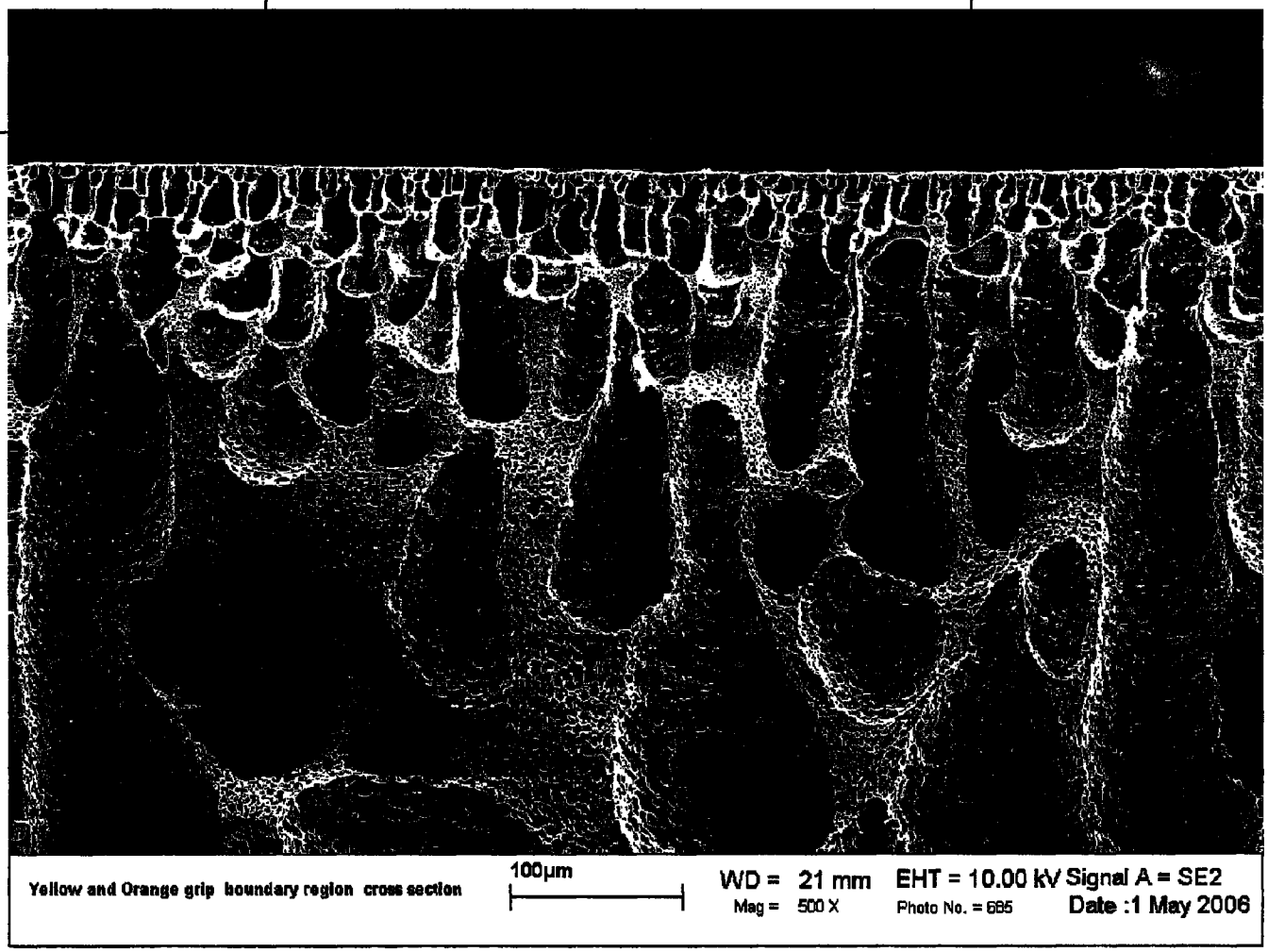
FIG. 26B is a SEM image at 500 times magnification of a portion of the cross-section shown in FIG. 26A.

FIG. 26B is a 500 times magnification of a portion of the cross-section shown in FIG. 26A. As is apparent from the figures, first 92 and second 102 polyurethanes are coagulated together to form coagulated region 112 with a substantially seamless structure between first color region 150 and second color region 152 and between the polyurethanes inside coagulated region 112.

Figure 27A:
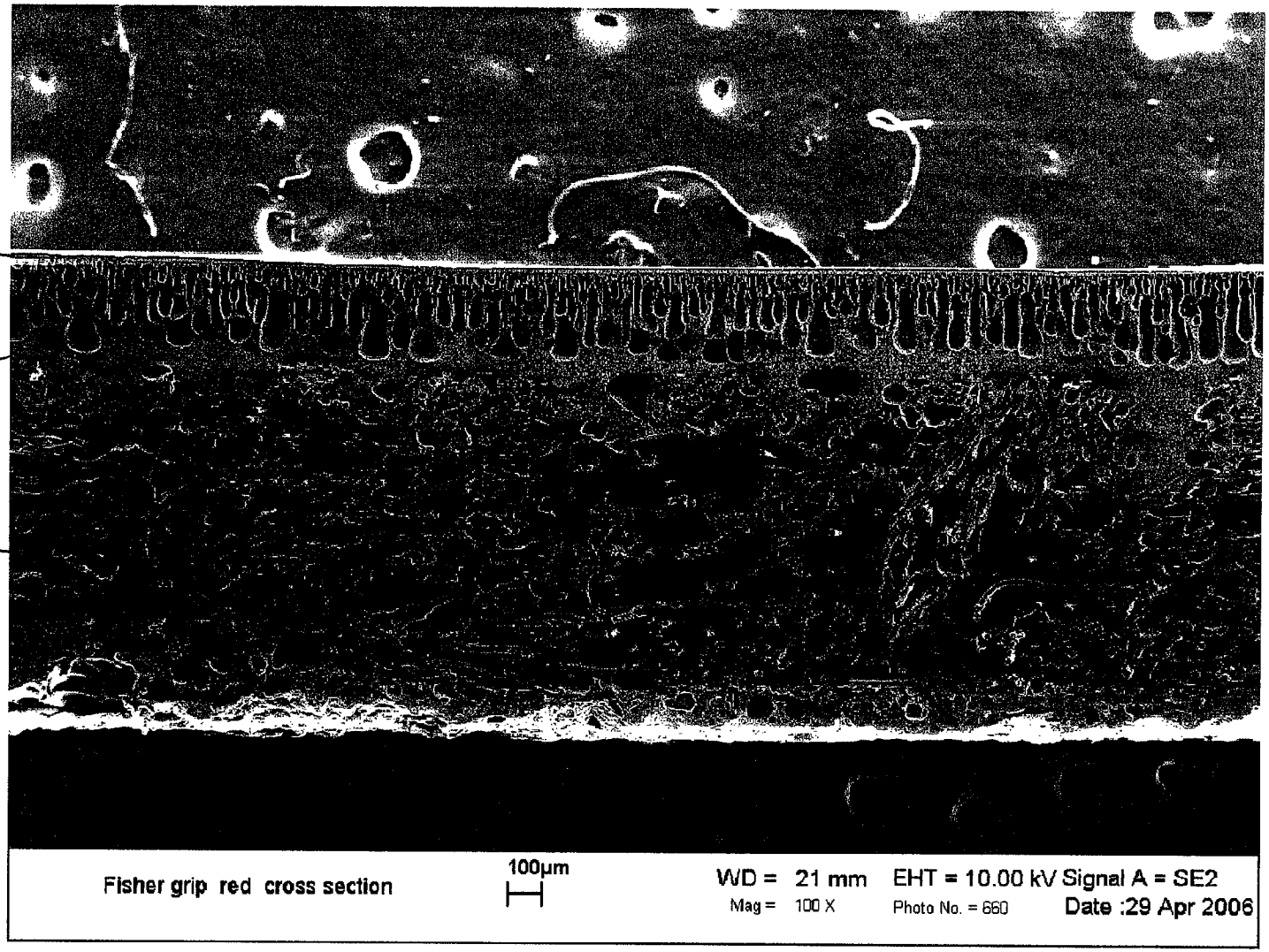
FIG. 27A is a SEM image at 100 times magnification of a cross-section of a sheet made according to a method of the prior art.
Figure 27B:
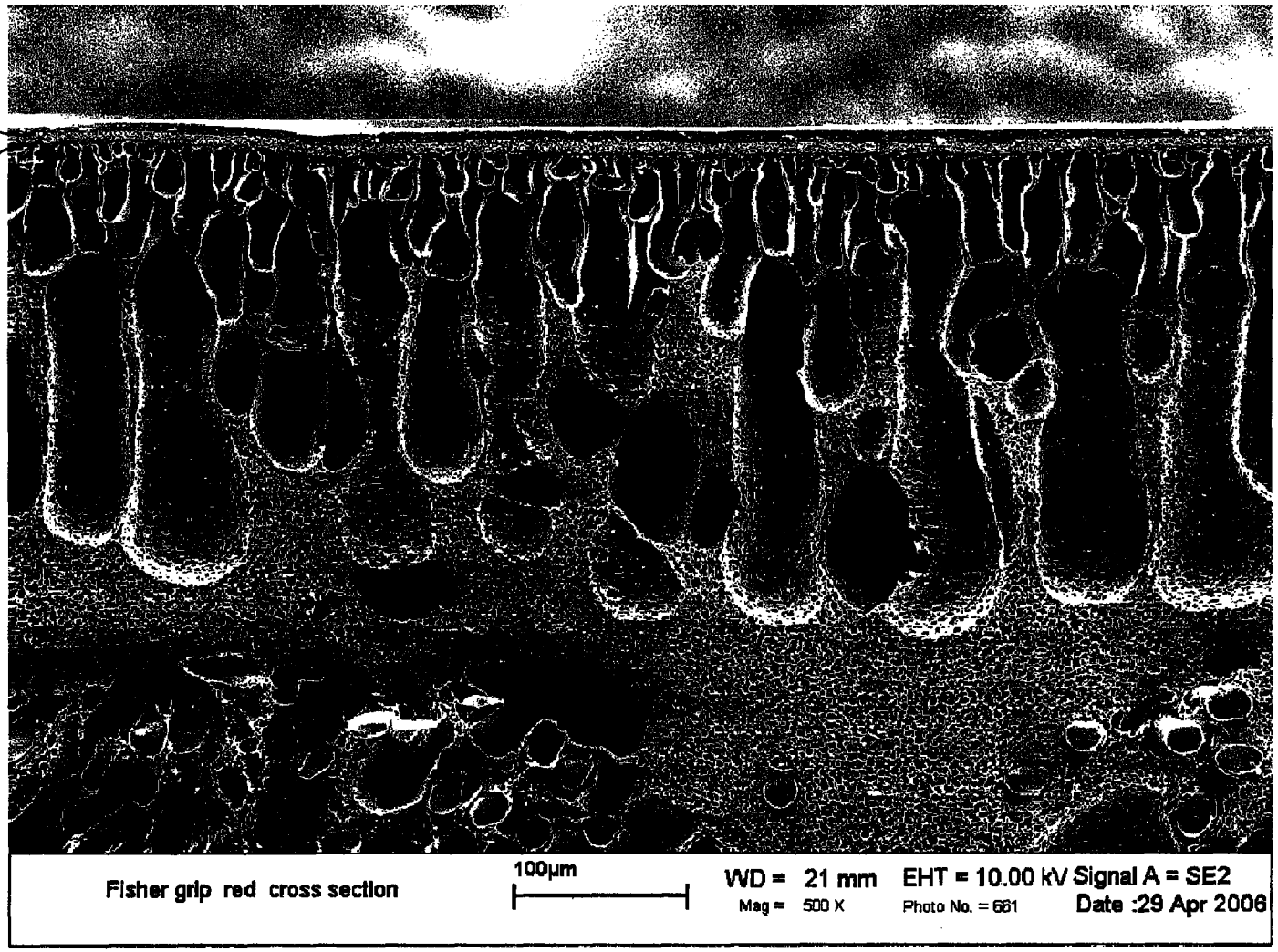
FIG. 27B is a SEM image at 500 times magnification of a portion of the cross-section shown in FIG. 27A.

FIGS. 26A and 26B may be contrasted with a prior art method of using paint to create a sheet with multiple colors, as shown in FIGS. 27A and 27B. In the prior art, a single polyurethane region 154 is coagulated onto a substrate 156 to form a sheet 158 including a coagulated region 160 having a top surface 168 and a bottom surface 170. To achieve regions of different color, a paint 162 having a top surface 164 and a bottom surface 166 would be applied to top surface 168 of coagulated polyurethane region 160 where desired. The polyurethane was coagulated prior to application of the paint and the paint would form a thin separate region over the surface of the coagulated polyurethane.

The prior art method of coating a coagulated region of polyurethane 160 with paint 162 alters the characteristics of sheet 158. As shown in FIG. 27A and in greater detail in FIG. 27B, paint 162 did not integrate with polyurethane region 154. Rather, bottom surface 166 of paint 162 bonds to top surface 168 of polyurethane region 154. In embodiments known to the Applicant, the paint coating the surface had different tactile characteristics from the polyurethane it coated, including different levels of tackiness or durometer. For example, painted grips are generally less tacky in the region covered by paint than in the unpainted regions of polyurethane. In addition, during use, the paint on the polyurethane may wear off giving the grip a weathered or worn appearance. Though valuable and unique, Applicant's other solutions for introducing contrasting characteristics (including the use of multiple sheets, strips and/or inserts) result in seams between the various components.

Embodiments created according to the above description allow for the manufacture of grips having regions of contrasting characteristics wherein the structure of the region is seamless. For example, a red polyurethane having a desired level of tackiness and durometer may be used in conjunction with a blue polyurethane having the same desired level of tackiness and durometer. The sheet formed from the two materials would include a uniquely colored pattern and a seamless structure having a substantially uniform level of tackiness and durometer.

Figure 28:
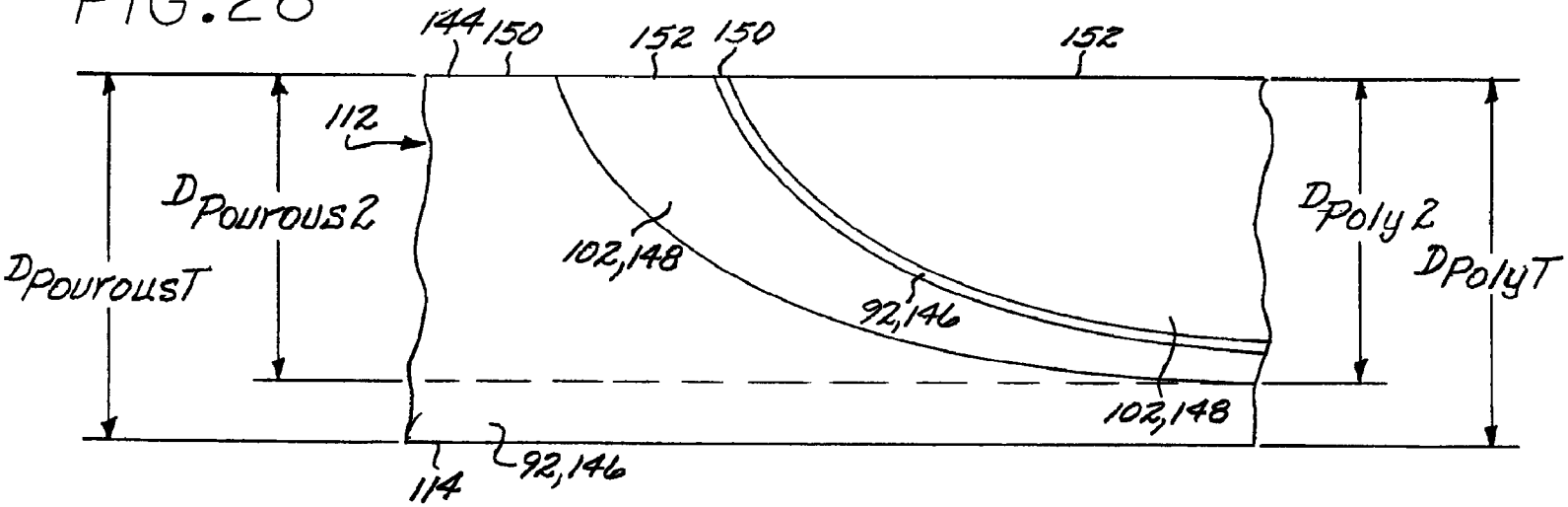
FIG. 28 is a partial schematic cross-sectional view taken along the line 28-28 in FIG. 24.

Referring now to FIG. 28, there is shown a partial schematic cross-sectional view of sheet 112 taken along the line 28-28 in FIG. 24. Contrasting regions 150 and 152 are visible on top surface 144. Due to the movement of nozzle 136 relative to web 94 during the application of second polyurethane 102 onto top surface 96 of first polyurethane 92, as discussed above, differing amounts of second polyurethane 102 are applied in different areas or regions. As the polyurethanes mix, second polyurethane 102 settles into first polyurethane 92.

After water bath 108, coagulated region 112 defines a total thickness $t_{PolyT}$ between its top surface 144 and its bottom surface 114. In various regions, second polyurethane 102 extends from top surface 144 into coagulated region 112 with a thickness $t_{Poly2}$. The ratio of $t_{Poly2}$ to $t_{PolyT}$ may vary, depending on a number of factors including the speed with which web 94 passes below nozzle 136, the flow rate of second polyurethane 102 from nozzle 136, and the rate of movement of nozzle 136 in the X and Y directions. In some embodiments, the maximum and, preferably, the average ratio of $t_{Poly2}$ to $t_{PolyT}$ in some regions is at least 1 to 15, 1 to 10, 1 to 5, 1 to 4, 1 to 3, and/or 1 to 2. In some regions, the ratio is 1 to 1 where second polyurethane 102 extends from top surface 144 to bottom surface 114. In some embodiments, the ratio varies in different regions of sheet 80.

As discussed above, coagulated region 112 is generally porous. This porous region has a total thickness $t_{PorousT}$ between top surface 144 and bottom surface 114 of coagulated region 112. In various regions, second polyurethane 102 extends from top surface 144 into porous coagulated region 112 with a maximum thickness $t_{Porous2}$. The ratio of $t_{Porous2}$ to $t_{PorousT}$ may vary. In some embodiments, the maximum and, preferably, the average ratio of $t_{Porous2}$ to $t_{PorousT}$ in some regions is at least 1 to 50, 1 to 40, 1 to 30, 1 to 20, 1 to 15, 1 to 10, 1 to 5, 1 to 4, 1 to 3, and/or 1 to 2. In some regions, the ratio is 1 to 1 where second polyurethane 102 extends through porous coagulated region 112 from top surface 144 to bottom surface 114. In some embodiments, the ratio varies in different regions of sheet 80.

Pattern 142 shown in the figures is an example of the patterns achievable with Applicant's method of making the polyurethane sheet. Other patterns are also possible. For example, in some embodiments, nozzle 136 is held steady as second polyurethane 102 is applied to web 94 to create a solid band of second polyurethane 102 across upper surface 96 of first polyurethane 92. Depending on how sheet 80 is formed into layered sheet L2, the band may extend horizontally, vertically, or at an angle on layered sheet L2.

In some embodiments, top surface 96 of first polyurethane region 92 forms substantially all of top surface 144 of coagulated region 112. In such embodiments, relatively smaller quantities of second polyurethane 102 may be applied prior to the coagulation process. In other embodiments, top surface 106 of second polyurethane 102 forms substantially all of top surface 144 of coagulated region 112. In such embodiments, relatively large quantities of second polyurethane 102 may be applied prior to the coagulation process. Embodiments of the present invention may include different regions of similar patterns. In some, the pattern may be repeated and positioned such that layered sheet L2 formed from the sheet includes at least three regions having contrasting characteristics, such as colors. In some embodiments, layered sheet L2 may be formed with at least 5 regions of contrasting characteristics. In some, there may be at least 7 regions of contrasting characteristics. In some, there may be 10 or more regions of contrasting characteristics. These regions of contrasting characteristics may be arranged throughout top surface 144 of coagulated region 112 of layered sheet L2, whether across the width of layered sheet L2, along the length of layered sheet L2, or in a combination of the two.

Figure 29:
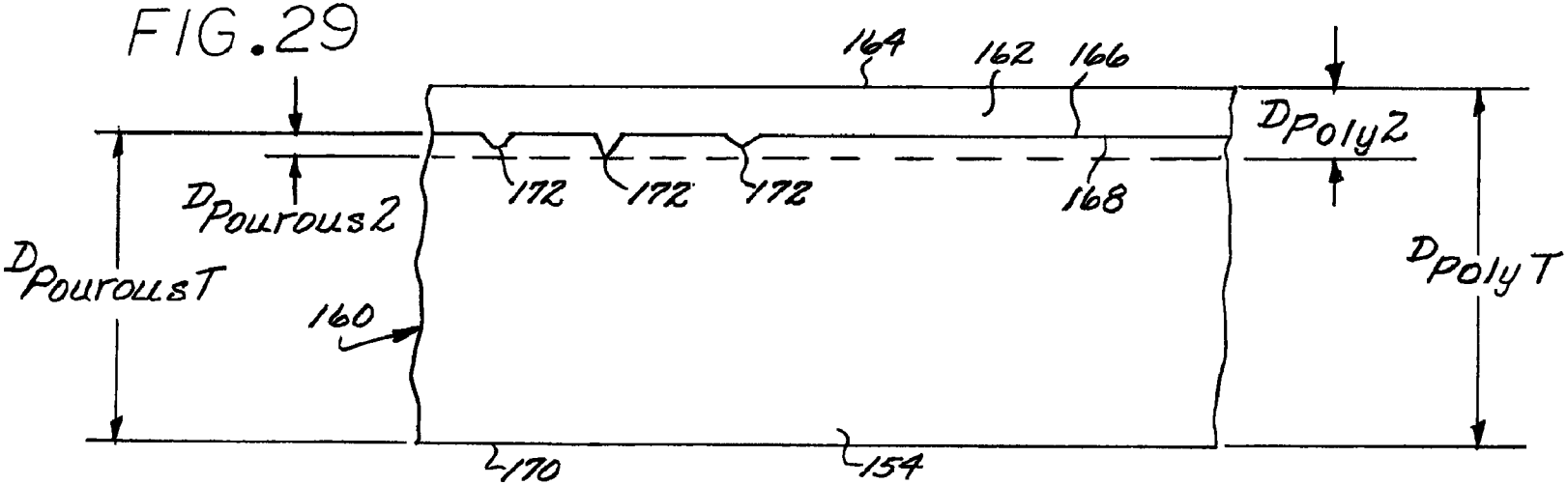
FIG. 29 is a partial schematic cross-sectional view of a painted sheet.

Referring now to FIG. 29, there is shown a partial schematic cross-sectional view of sheet 158 shown in FIGS. 27A and 27B. Coagulated region 160 is porous and includes generally smooth top surface 168 and bottom surface 170. Top surface 168 may include one or more irregularities 172 which may extend downward into coagulated region 160. Paint 162 is applied over top surface 168 of coagulated region 160. Due to irregularities 172 in top surface 168 of coagulated region 160, paint 162 may extend into coagulated region 160 with a thickness $t_{Porous2}$. Though unclear, the ratio of $t_{Porous2}$ to $t_{PorousT}$ shown in FIG. 27B appears to be no more than 1 to 100. Thus, if the paint was a second polymer applied to the surface of a coagulated region, the ratio of $t_{Porous2}$ to $t_{PorousT}$ of a paint covered sheet is far from the 1 to 50 ratio discussed above.

Figure 30:
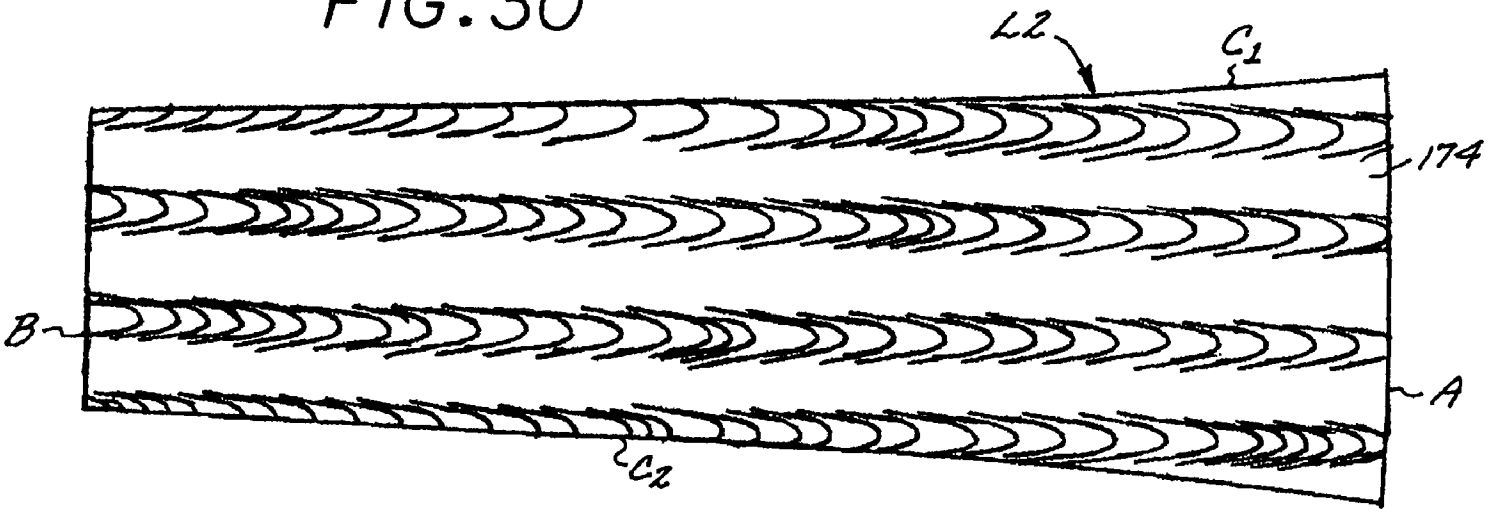
FIG. 30 is a front view of a layered sheet of a grip according to some embodiments.

As shown in FIG. 30, sheet 80 may be formed into layered sheet L2. In some embodiments, layered sheet L2 is die cut from sheet 80. As will be understood by those of skill in the art, sheet 80 may be formed into any of a number of shapes, including strips, panels, inserts, or panels with cut-outs as may be appropriate for the particular application.

Layered sheet L2 includes a top surface 174, a top region A, a bottom region B, a first side region $C_1$, and a second side region $C_2$. A line drawn from top region A to bottom region B on at least a portion of top surface 174 preferably crosses multiple regions of polyurethane having a different characteristic. In some embodiments, layered sheet L2 may include at least 2, at least 3, at least 5, at least 7, or at least 10 regions having a different characteristic along the line drawn from top region A to bottom region B on at least a portion of top surface 174. In some embodiments, layered sheet L2 may include in the range of between 2 and 500 regions of at least one different characteristic along the line. It should be understood that the different characteristics of the regions may be alternating two or more colors along the line. Alternatively, the different characteristics of the regions may be alternating levels of other characteristics such as tackiness or durometer along the line.

Similarly, a line drawn from first side region $C_1$ to second side region $C_2$ on at least a portion of top surface 174 also will preferably cross multiple regions having different characteristics. In some embodiments, layered sheet L2 may include at least 2, at least 3, at least 5, at least 7, or at least 10 regions having a different characteristic along the line drawn from first side region $C_1$ to second side region $C_2$ on at least a portion of top surface 174. In some embodiments, layered sheet L2 may include in the range of between 2 and 500 regions of at least one different characteristic along the line.

Likewise, a line drawn into layered sheet L2 from top surface 174 to bottom surface 114 of coagulated region 112 may cross multiple regions. In some embodiments, layered sheet L2 may include at least 2, at least 3, at least 5, at least 7, or at least 10 regions having different characteristics along the line drawn from its top surface 174 to bottom surface 114 of coagulated region 112. In some embodiments, layered sheet L2 may include in the range of between 2 and 50 regions of at least one different characteristic along the line.

As will be understood by those of skill in the art, features of layered sheet L2 may be combined with features of layered sheet L1 discussed above as desired. For example, as discussed above with respect to the other layered sheets, layered sheet L2 may be further enhanced with a friction enhancing pattern.

Figure 31:
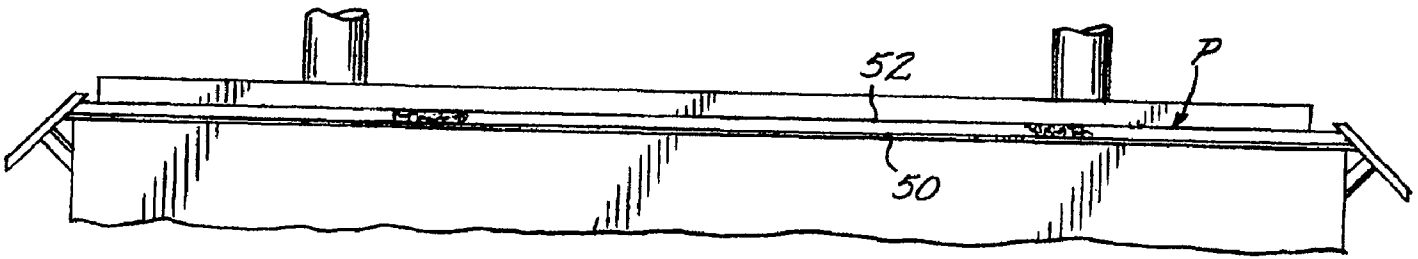
FIG. 31 shows the top and bottom edges of a layered sheet being skived.

Referring now to FIG. 31 and generally to layered sheets according to this disclosure, in some embodiments, top A and bottom B regions of layered sheet L are skived. Generally, side regions $C_1$, $C_2$ need not be skived as raised portion R of tube T includes substantially axially extending surfaces 46 which engage side regions $C_1$, $C_2$ when layered sheet L is attached to tube T. It will be noted that, in some embodiments not shown, first $C_1$ and second $C_2$ side regions of layered sheet L can be skived at various angles to accommodate different angels a of surfaces 46 as needed.

Referring generally to the layered sheets disclosed herein, top surface 174 of layered sheet L is in direct contact with the hand of the user using a grip G. However, as one of skill in the art would appreciate, an additional coating region over layered sheet L may be included. It should be understood that the top surface of a grip embodying the disclosure presented above may also be coated, in whole or in part, by means of a brush, nozzle, spray or the like with a thin region of polyurethane and/or other material (not shown) to, for example, protect such surface, add tackiness thereto, and/or increase the durability thereof. The additional coating region is preferably transparent, or semi-transparent, such that some or all of any visual pattern on the outer surface of layered sheet L remains visible. The additional coating region may be somewhat opaque, as long as a portion of the layered sheet L is observable through the additional coating region. The additional coating region may be incorporated into a previously formed grip G or may be applied to the layered sheet L prior to attachment to tube T. If used, the additional coating region would be in direct contact with the user's hand rather than the top surface of the layered sheet. However, even when an additional coating region is included, the top surface of the layered sheet L is considered to be the top surface of the grip G. If an additional coating region is included over the top surface of the grip, this region may also be further enhanced with a friction enhancing pattern as discussed herein.

In addition to being attached to tube T configured for use with irons, as shown in FIG. 2, any of the layered sheets disclosed herein may also be attached to a tube configured for use with putters (not shown). Such a putter tube may include a substantially flat region as shown, for example, in Applicant's U.S. Pat. Nos. 6,843,732 and 6,857,971.

Figure 32:
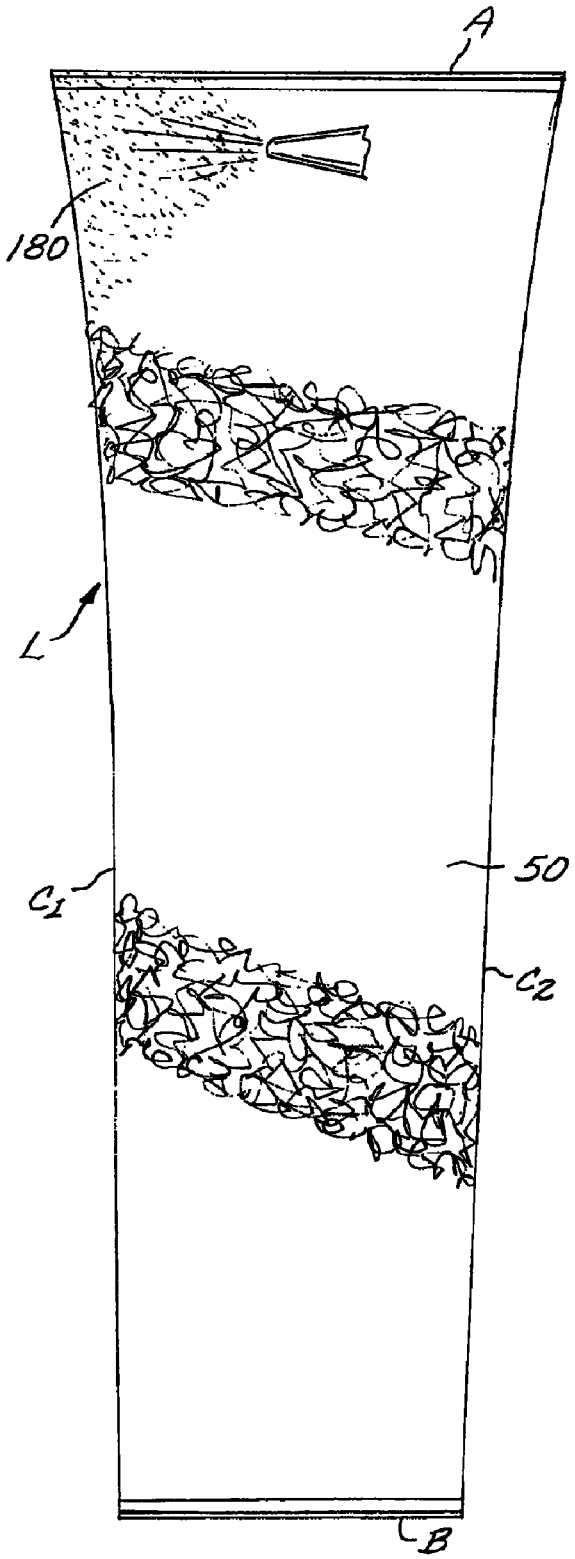
FIG. 32 is a rear view showing adhesive being applied to a layered sheet of a grip according to some embodiments.
Figure 33:
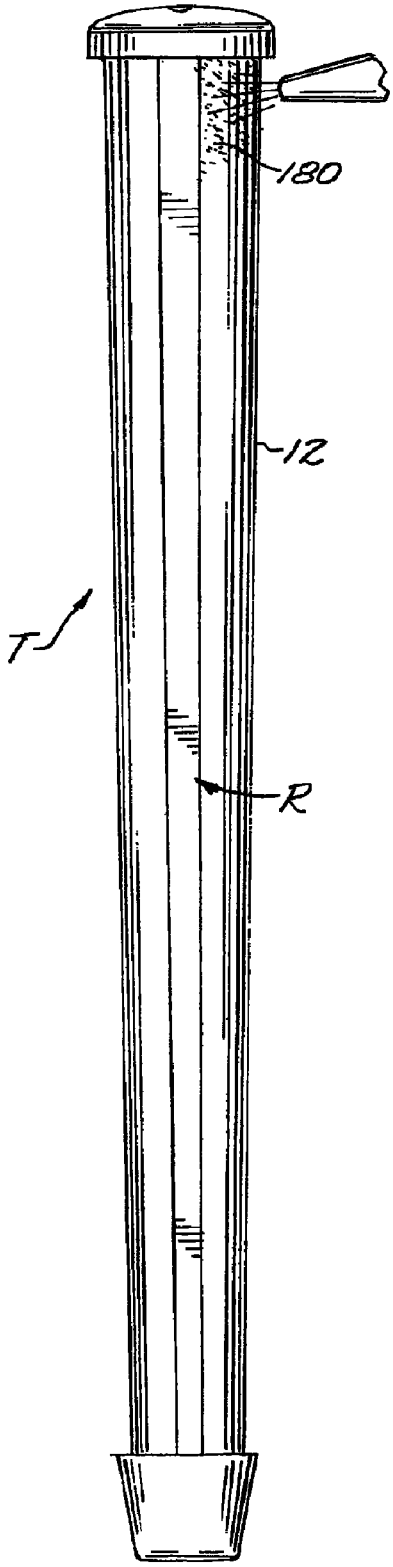
FIG. 33 is a front view showing adhesive being applied to the exterior of a tube according to some embodiments.
Figure 34:
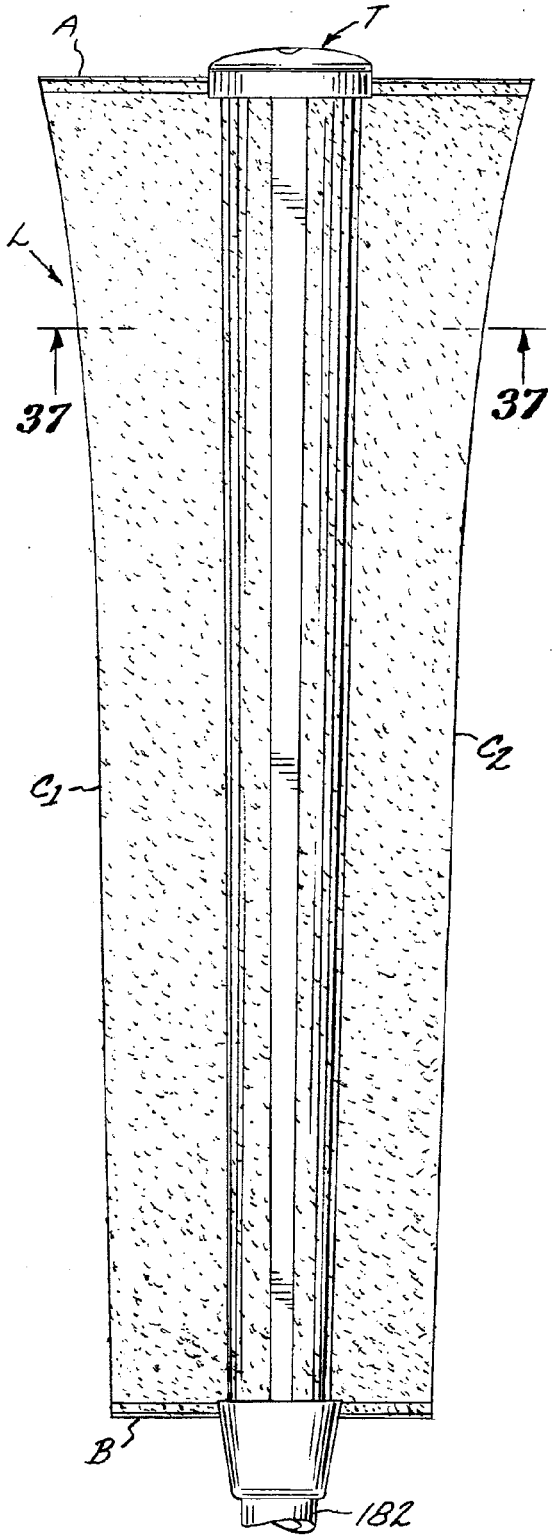
FIG. 34 is a side elevational view showing a step in wrapping and adhering a layered sheet to a tube.
Figure 35:
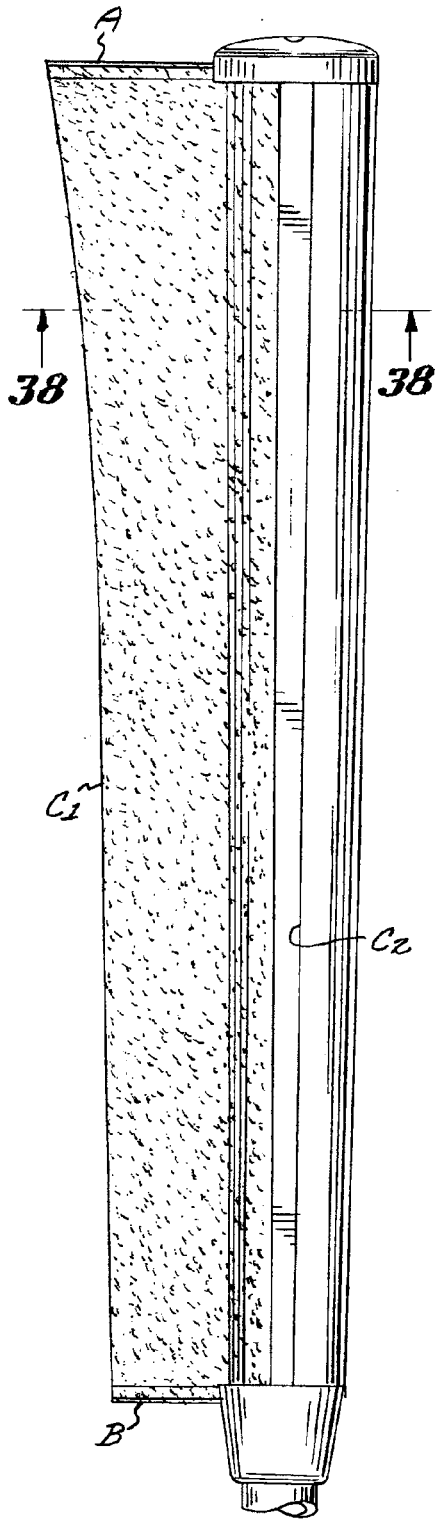
FIG. 35 is a side elevational view showing another step in wrapping a layered sheet around a tube.

Referring now to FIGS. 32 through 42, layered sheet L is shown being applied to tube T to form grip G. In FIG. 32 the inner surface of the layer 50 is shown receiving an adhesive 180 by means of a nozzle, brush or the like. In FIG. 33 support surface 12 of tube T is shown receiving an adhesive 180 by means of a nozzle, brush or the like.

Figure 36:
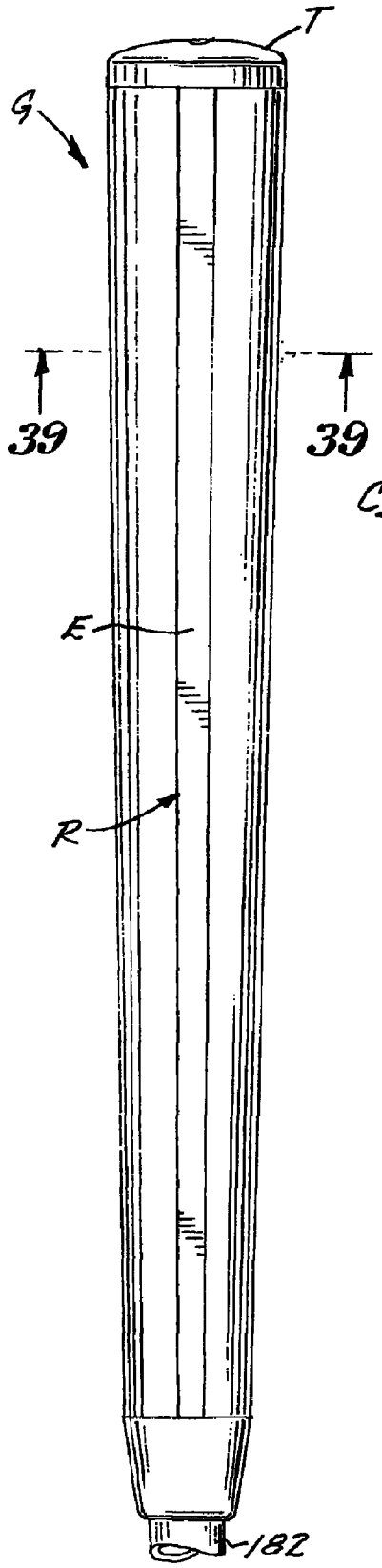
FIG. 36 is a side elevational view showing a layered sheet after it has been adhered to a tube according to some embodiments.
Figure 37:
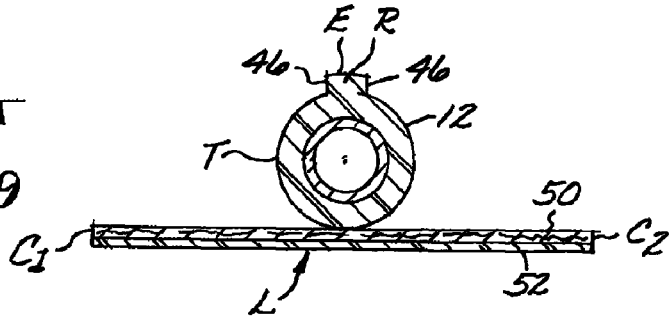
FIG. 37 is a horizontal sectional view taken along line 37-37 of FIG. 34.
Figure 38:
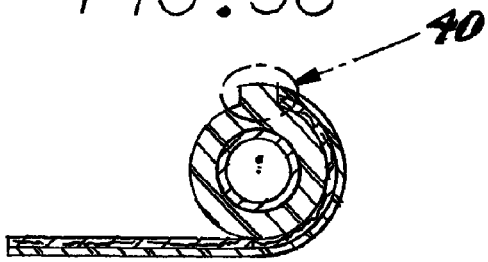
FIG. 38 is a horizontal sectional view taken along line 38-38 of FIG. 35.
Figure 39:
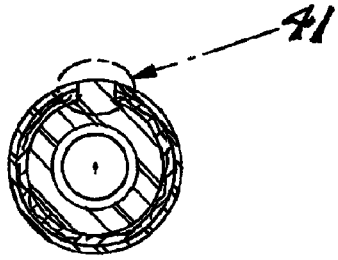
FIG. 39 is a horizontal sectional view taken along line 39-39 of FIG. 36.
Figure 40:
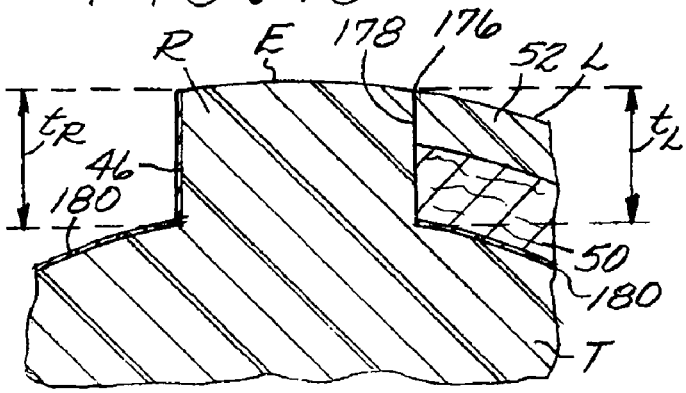
FIG. 40 is an enlarged view of the encircled area designated 40 in FIG. 38.
Figure 41:
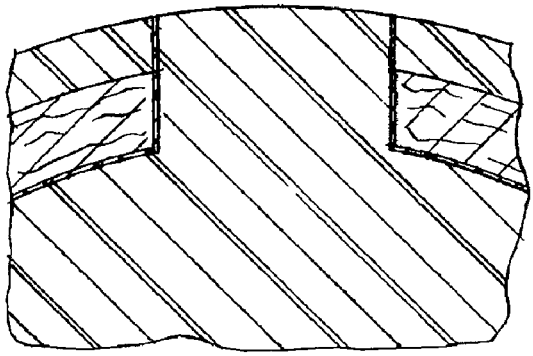
FIG. 41 is an enlarged view of the encircled area designated 41 in FIG. 39.

FIGS. 34 through 42 shows the layered sheet L being wrapped around and adhered to tube T. During this operation, top region A of layered sheet L will desirably be manually inserted within slot 14 of cover 10, while bottom region B of layered sheet L will desirably be manually inserted within slot 30 of ring 8. As shown in FIGS. 40 though 42, side regions $C_1$, $C_2$ of layered sheet L will be adhered to raised portion R by one or more suitable adhesives. A suitable adhesive has a mixture of AD-86 (Toluene, 35%; Methyl Ethyl Ketone, 50%; Polyurethane, 15%) and AD-RFE (Ethyl Acetate, 78%; Polyisocynate, 22%). As layered sheet L is being wrapped about and adhered to tube T, tube T will generally be temporarily supported on a collapsible mandrel 182 in a conventional manner. A completed grip G is shown in FIG. 36.

As discussed above, thickness $t_R$ of portion R is generally constant along its entirety and is configured to be approximately equal to thickness $t_L$ of the layered sheet L (see, e.g., FIG. 40). In some embodiments, the approximately equal thicknesses of portion R and layered sheet L promote a substantially smooth surface interface 176 between the two as they cooperate to define gripping surface GS of grip G.

Figure 42:
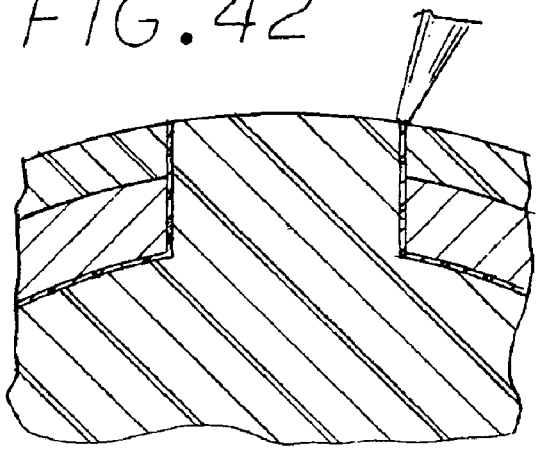
FIG. 42 is an enlarged view of a step in making a grip according to some embodiments.

Referring now to FIG. 42 there is shown a modification of a grip G. In this modification, the intersection 178 between layered sheet L and raised portion R includes a small quantity of liquid polyurethane coated over the intersection by a nozzle or brush. The polyurethane can also be placed between side regions $C_1$, $C_2$ of layered sheet L and connecting surfaces 46 of raised portion R. After the polyurethane hardens, in some embodiments the polyurethane may be buffed by a suitable brush or the like to smoothly blend the surface of the grip while in other embodiments, the polyurethane is not buffed.

As mentioned above, it should be understood that the outer surface of a grip embodying the disclosure herein may be coated by means of a brush or spray or the like with a thin layer of polymer such as polyurethane (not shown) to, for example, protect such surface, add tackiness thereto and/or increase the durability thereof.

Referring now to FIGS. 43 through 47, there is shown another embodiment of a tube T1. As discussed above, raised portion R may have various configurations. In the embodiment illustrated in FIGS. 43 through 47, tube T1 includes two raised portions $R_1$ and $R_2$ defining exposed surfaces $E_1$ and $E_2$, respectively.

In the illustrated embodiment, raised portion $R_1$ is formed into a substantially elliptical shape having its major axis substantially parallel to the longitudinal axis of tube T1. Raised portion $R_1$ desirably extends outward from support surface 12 of tube T1 between first 2 and second 4 ends of tube T1. In some embodiments, portion $R_1$ is positioned on tube T1 such that in the completed grip, exposed surface $E_1$ of raised portion $R_1$ is positioned to engage the thumbs of a user grasping the grip during a swing. In some embodiments, raised portion $R_1$ extends at least the length of an adult's finger pad in a circumferential direction. In some embodiments, raised portion $R_1$ extends at least the length of an adult's finger pad along the longitudinal direction. For purposes of this application, the length of an adult's finger pad is defined as being one inch.

In the illustrated embodiment, raised portion $R_2$ extends substantially the length of tube T1 and is positioned on the side opposite $R_1$. Near first end 2 of tube T1, raised portion $R_1$ resembles raised portion R of the previously discussed tube. Slightly above midway up tube T1, raised portion $R_1$ widens such that exposed surface $E_2$ covers substantially all of the upper back portion of tube T1. As shown, in some embodiments only a portion of raised portion $R_1$ extends to cover 10. As will be understood, more or less of raised portion $R_1$ may extend to cover 10. As discussed previously, where raised portion $R_1$ connects with cover 10 of some embodiments, raised portion $R_1$ may be integrally formed with lip 16 and may extend through slot 14 to eliminate slot 14 in some or all of the area raised portion $R_1$ contacts cover 10. In such instances, slot 14 extends around only a portion of the circumference of tube T. In some embodiments, connecting surface 46 of raised portion $R_1$ extends substantially perpendicular from support surface 12 of tube T. Alternatively, one or more portions of connecting surface 46 may be angled to, for example, correspond to additional skiving on the inner side of layered sheet L (not shown).

Figure 46:
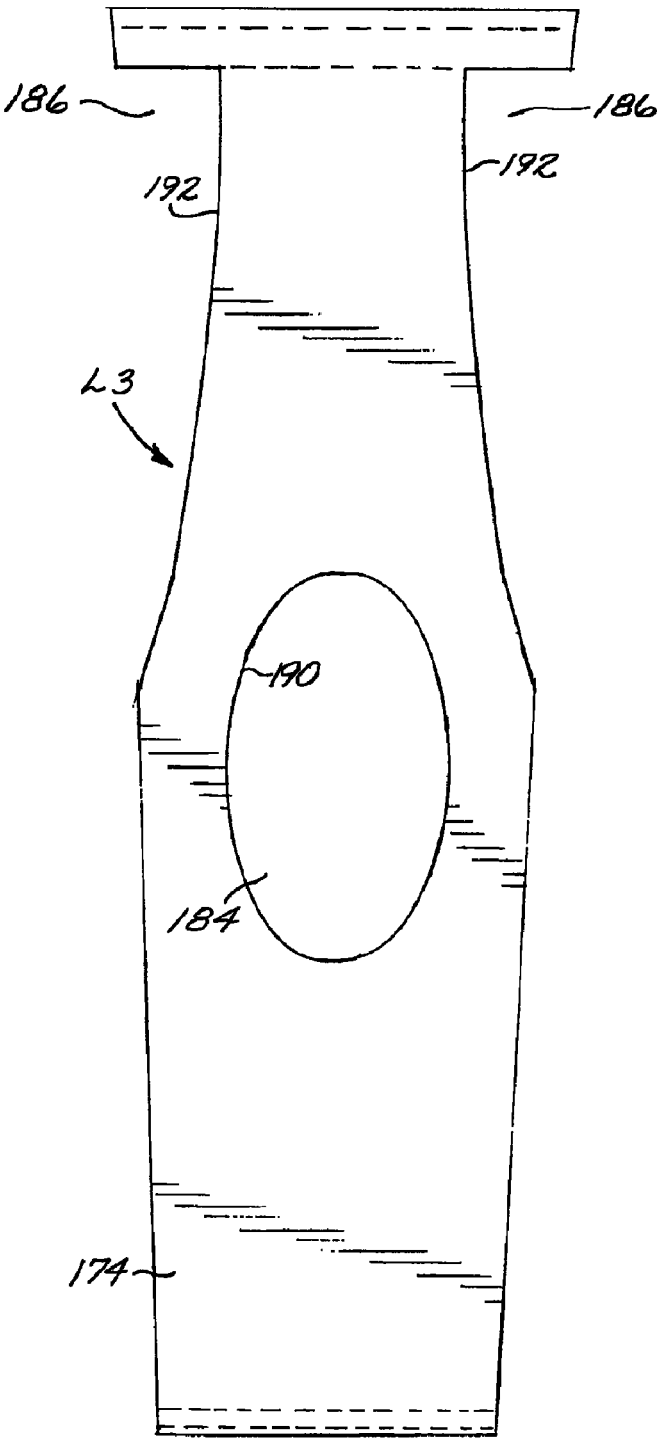
FIG. 46 is a front view of a layered sheet for use with the tube shown in FIG. 43.

As shown in FIG. 46, a layered sheet L3 has been configured to correspond with tube T1 and, in particular, has been adapted to correspond with support surface 12 of tube T1 around raised portions $R_1$ and $R_2$. L3 includes cut-outs 184 and 186. Cut-out 184 is substantially elliptical in shape defined by edge 190 and has its major axis substantially parallel to the longitudinal axis of tube T1. As such, cut-out 184 corresponds to the overall shape of raised portion $R_1$. When layered sheet L3 is wrapped about support surface 12, raised portion $R_1$ desirably fits within cut-out 184 and is desirably substantially engaged by edge 190 of cut-out 184. Cut-outs 186 are defined by edge 192, are substantially symmetrical and are configured to correspond to raised portion $R_2$. Similarly, when layered sheet L3 is wrapped about support surface 12, raised portion $R_2$ desirably fits within cut-outs 186 and is desirably substantially engaged by edge 192 of cut-outs 186.

Figure 47:
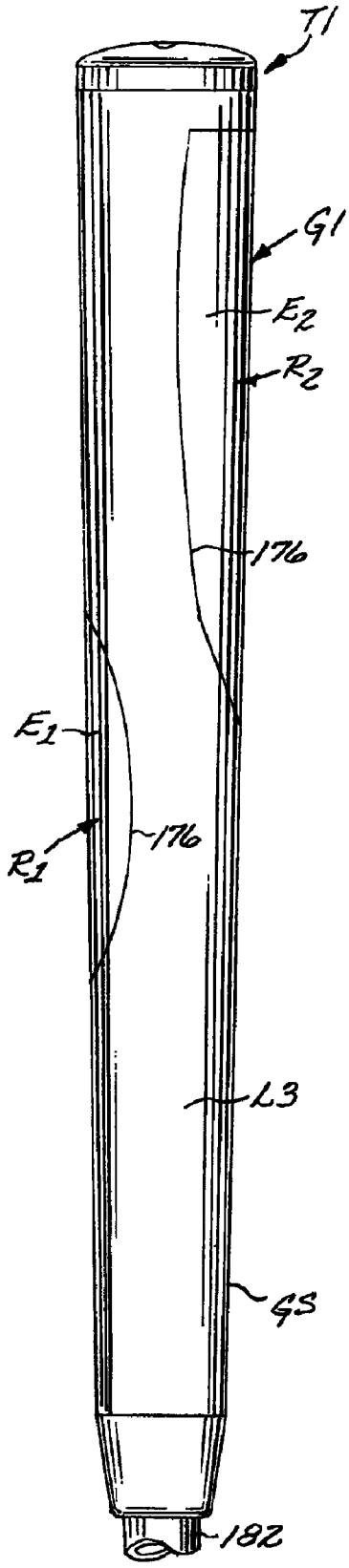
FIG. 47 is a side elevational view of a grip after the layered sheet shown in FIG. 46 has been adhered to the tube shown in FIG. 43.

Referring now to FIG. 47, combined layered sheet L3 and tube T1 form grip G1. Gripping surface GS includes outer surface 174 of layered sheet L3, exposed surface $E_1$, and exposed surface $E_2$. The surface interface 176 between the outer surface 174 of layered sheet L3 and exposed surfaces $E_1$, $E_2$ is desirably substantially smooth. As in the other embodiments discussed above, layered sheet L3 is adhered or bonded to support surface 12 of tube T1. In some embodiments, layered sheet L3 is wrapped around tube T1 such that layered sheet L3 abuts connecting surface 46 of the raised portion(s). In some embodiments, at lease a portion of inner layer 50 and at least a portion of outer layer 52 abut connecting surface 46 of the raised portion(s). Desirably, inner layer 50 of layered sheet L3 is adhered to support surface 12 of tube T1. In addition, inner layer 50 is also desirably adhered or bonded to connecting surface 46 of raised portions $R_1$ and $R_2$. Outer layer 52 is also desirably adhered or bonded to connecting surface 46 of raised portions $R_1$ and $R_2$. As disclosed herein above, in some embodiments, and particularly in those wherein outer layer 52 comprises a polyurethane, intersections 178 between layered sheet L3 and tube T1 may include, in addition to adhesive 180, a deposit of polyurethane to assist in bonding or adhering layered sheet L3, and in particular outer layer 52 of layered sheet L3 to the raised portions. In some embodiments, raised portion R may be within approximately ⅛ inch, 1/16 inch or in direct contact with the layered sheet around substantially the entire circumference of the raised portion. Alternatively, the layered sheet may be joined or bonded to the raised portion.

In some embodiments, tube T includes rubber with an IRHD hardness rating (International Rubber Hardness Degrees) between approximately 60 and 80 degrees. In some embodiments, raised portion R also has an IRHD hardness rating between approximately 60 and 80 degrees. As discussed above, in some embodiments outer layer 52 includes polyurethane. In some embodiments, outer layer 52 has an IRHD hardness rating of between approximately 40 and 60 degrees. In some embodiments, the ratio of the hardness of outer layer 52 and raised portion R is, approximately 1 to 1. In some embodiments, the hardness ratio is between approximately 1 to 2 and approximately 1 to 1. In some embodiments where the hardness ratio is approximately 1 to 1, one or more other characteristics, such as tackiness, durability, color, or friction enhancing pattern on the outer surface, may differentiate raised portion R and outer layer 52 on the gripping surface.

It will be understood that the foregoing is only illustrative of the principles of the invention, and that various modifications, alterations and combinations can be made by those skilled in the art without departing from the scope and spirit of the invention.

What is claimed is:

1. A method of making a grip for use with a golf club, said method comprising the steps of:

providing a tube having a first end, a second end and a support surface extending at least partially between said first and second ends;

providing a raised portion on said tube having an exposed surface and a connecting surface extending between said support surface and said exposed surface;

providing a layered sheet comprising an inner layer and an outer layer, said layered sheet configured to overlay said support surface and not said exposed surface, wherein said layered sheet has an outer surface and comprises first and second polymers polymerized side by side such that said outer surface comprises at least a portion of both first and second polymers;

wrapping said layered sheet around said tube such that said layered sheet surrounds said support surface of said tube, leaving said exposed surface uncovered by said sheet; and adhering said inner layer of said layered sheet to said support surface, wherein the outer surface of said layered sheet and said exposed surface of said raised portion cooperate to define a gripping surface positioned to be gripped by a golfer.

2. The method of claim 1, wherein said providing said raised portion on said tube comprises providing said raised portion on said tube having said exposed surface extending at least one inch in a circumferential direction.

3. The method as in claim 1, wherein said second end comprises an outwardly and downwardly extending lip having an inner and outer surface, said inner surface cooperating with a first portion of said support surface to form a first slot.

4. The method as in claim 3, further comprising the step of adhering a first portion of said layered sheet to said first portion of said support surface.

5. The method as in claim 4, wherein said first end further defines an opening configured to couple with a shaft of said golf club.

6. The method as in claim 4, wherein said tube defines an inner hollow cavity configured to accept a shaft of said golf club, said second end further defining a cover configured to substantially enclose said second end of said tube.

7. The method as in claim 4, wherein said first end comprises an outwardly and upwardly extending portion cooperating with a second portion of said support surface to form a second slot.

8. The method as in claim 7, further comprising the step of adhering a second portion of said layered sheet to said second portion of said support surface.

9. The method as in claim 1, further comprising the step of integrally forming said tube and said raised portion.

10. The method as in claim 1, wherein said raised portion has a first physical characteristic and said outer layer of said layered sheet has a second physical characteristic different than said first characteristic.

11. The method as in claim 1, wherein the interface between said exposed surface and said outer surface of said layered sheet is substantially smooth.

12. The method as in claim 1, further comprising the step of forming said raised portion into a first shape.

13. The method as in claim 12, wherein said tube has a longitudinal axis and said shape is substantially elliptical with a major axis extending generally parallel to said longitudinal axis of said tube and extending at least one inch along said longitudinal axis.

14. The method as in claim 12, further comprising the steps of:

forming said layered sheet with a cut-out corresponding to said shape of said raised portion; and positioning said layered sheet onto said support surface such that said raised portion fits within said cut-out and is substantially engaged by said cut-out.

15. The method as in claim 1, wherein said first polymer comprises a first characteristic, said second polymer comprises a second characteristic, and said first and second characteristics are different.

16. The method as in claim 1, wherein said first and second polymers comprise polyurethane and they are polymerized together by a wet coagulation process.

17. A method of making a golf club comprising the steps of:

providing a golf club shaft having a handle end;

making a grip comprising the steps of:

providing a tube having a first end with an opening configured to accept a handle end of a golf club shaft, a second end and a support surface extending at least partially between said first and second ends;

providing a raised portion on said tube having an exposed surface and a connecting surface extending between said support surface and said exposed surface;

providing a layered sheet comprising an inner layer and an outer layer, said layered sheet configured to overlay said support surface and not said exposed surface, wherein said layered sheet has an outer surface and comprises first and second polymers polymerized side by side such that said outer surface comprises at least a portion of both first and second polymers;

wrapping said layered sheet around said tube such that said layered sheet surrounds said support surface of said tube, leaving said exposed surface uncovered by said sheet; and adhering said inner layer of said layered sheet to said support surface, wherein the outer surface of said layered sheet and said exposed surface of said raised portion cooperate to define a gripping surface positioned to be gripped by a golfer; and inserting said handle end of said golf club shaft into said opening of said first end of said tube.

18. A grip for use with a golf club, said grip comprising:

a tube having a first end, a second end and a support surface extending at least partially between said first and second ends;

a raised portion on said tube having an exposed surface and a connecting surface extending between said support surface and said exposed surface;

a layered sheet comprising an inner layer and an outer layer, said layered sheet configured to overlay said support surface and not said exposed surface, wherein said layered sheet has an outer surface and comprises first and second polymers polymerized side by side such that said outer surface comprises at least a portion of both first and second polymers;

said layered sheet being wrapped about said tube such that said layered sheet surrounds said support surface of said tube, leaving said exposed surface uncovered by said sheet; and said inner layer of said layered sheet being adhered to said support surface, wherein the outer surface of said layered sheet and said exposed surface of said raised portion cooperate to define a gripping surface positioned to be gripped by a golfer.

19. A grip as in claim 18, wherein said exposed surface extending at least one inch in a circumferential direction.

20. A grip as in claim 18, wherein said second end comprises an outwardly and downwardly extending lip having an inner and outer surface, said inner surface cooperating with a first portion of said support surface to form a first slot.

21. A grip as in claim 20, wherein a first portion of said layered sheet is attached to said first portion of said support surface.

22. A grip as in claim 21, wherein said first end further defines an opening configured to couple with a shaft of said golf club.

23. A grip as in claim 21, wherein said tube defines an inner hollow cavity configured to accept a shaft of said golf club, said second end further defining a cover configured to substantially enclose said second end of said tube.

24. A grip as in claim 20, wherein said first end comprises an outwardly and upwardly extending portion cooperating with a second portion of said support surface to form a second slot.

25. A grip as in claim 24, wherein a second portion of said layered sheet is attached to said second portion of said support surface.

26. A grip as in claim 18, wherein said tube and said raised portion are integrally formed.

27. A grip as in claim 18, wherein said raised portion has a first physical characteristic and said outer layer of said layered sheet has a second physical characteristic different than said first characteristic.

28. A grip as in claim 18, wherein the interface between said exposed surface and said outer surface of said layered sheet is substantially smooth.

29. A grip as in claim 18, wherein said raised portion defines a first shape.

30. A grip as in claim 29, wherein said tube has a longitudinal axis and said shape is substantially elliptical with a major axis extending generally parallel to said longitudinal axis of said tube.

31. A grip as in claim 30, wherein said layered sheet includes a cut-out corresponding to said first shape and said layered sheet is positioned onto said support surface such that said raised portion fits within said cut-out and is substantially engaged by said cut-out.

32. A grip as in claim 18, wherein said first polymer comprises a first characteristic, said second polymer comprises a second characteristic, and said first and second characteristics are different, wherein said first polymer comprises a first characteristic, said second polymer comprises a second characteristic, and said first and second characteristics are different.

33. A grip as in claim 18, wherein said first and second polymers comprise polyurethane and they are polymerized together by a wet coagulation process.

34. A golf club comprising:

a golf club shaft having a handle end;

a grip positioned on said handle end of said golf club shaft, said grip comprising:

a tube having a first end with an opening configured to accept a handle end of a golf club shaft, a second end and a support surface extending at least partially between said first and second ends;

a raised portion on said tube having an exposed surface and a connecting surface extending between said support surface and said exposed surface;

a layered sheet comprising an inner layer and an outer layer, said layered sheet configured to overlay said support surface and not said exposed surface, wherein said layered sheet has an outer surface and comprises first and second polymers polymerized side by side such that said outer surface comprises at least a portion of both first and second polymers;

said layered sheet being wrapped about said tube such that said layered sheet surrounds said support surface of said tube, leaving said exposed surface uncovered by said sheet; and said inner layer of said layered sheet being adhered to said support surface, wherein the outer surface of said layered sheet and said exposed surface of said raised portion cooperate to define a gripping surface positioned to be gripped by a golfer.

* * * * *